US009284723B2

(12) United States Patent
Esche et al.

(10) Patent No.: US 9,284,723 B2
(45) Date of Patent: Mar. 15, 2016

(54) MAGNETIC DOCKING FAUCET

(71) Applicant: Kohler Co., Kohler, WI (US)

(72) Inventors: John C. Esche, Kohler, WI (US); Perry D. Erickson, Sheboygan, WI (US); Roger W. Murphy, Kohler, WI (US); William R. Bares, Fredonia, WI (US)

(73) Assignee: KOHLER CO., Kohler, WI (US)

( * ) Notice: Subject to any disclaimer, the term of this patent is extended or adjusted under 35 U.S.C. 154(b) by 225 days.

(21) Appl. No.: 14/080,309

(22) Filed: Nov. 14, 2013

(65) Prior Publication Data

US 2014/0069520 A1 Mar. 13, 2014

Related U.S. Application Data

(63) Continuation-in-part of application No. 13/787,262, filed on Mar. 6, 2013.

(60) Provisional application No. 61/676,711, filed on Jul. 27, 2012.

(51) Int. Cl.
*E03C 1/04* (2006.01)

(52) U.S. Cl.
CPC ..... *E03C 1/0404* (2013.01); *E03C 2001/0415* (2013.01); *Y10T 137/598* (2015.04)

(58) Field of Classification Search
CPC ..... E03C 1/0404; Y10T 137/598
USPC ..... 137/801; 4/675, 678
See application file for complete search history.

(56) References Cited

U.S. PATENT DOCUMENTS

| | | | |
|---|---|---|---|
| 2,697,642 | A | 12/1954 | Rudy |
| 2,793,057 | A | 5/1957 | McGugin |
| 3,104,088 | A | 9/1963 | Cator |
| 3,181,895 | A | 5/1965 | Cator |
| 3,265,075 | A | 8/1966 | Edman et al. |
| 3,586,048 | A | 6/1971 | Arnold |

(Continued)

FOREIGN PATENT DOCUMENTS

| | | |
|---|---|---|
| CN | 101812858 | 8/2010 |
| CN | 201715084 | 1/2011 |

(Continued)

OTHER PUBLICATIONS

European Search Report dated May 7, 2015 for Application No. 13178072.8, 6 pages.

(Continued)

*Primary Examiner* — Mary McManmon
*Assistant Examiner* — Nicole Wentlandt
(74) *Attorney, Agent, or Firm* — Foley & Lardner LLP

(57) ABSTRACT

A faucet includes a spout and a sprayhead movable between a docked position, in which the sprayhead is in contact with the spout, and an undocked position, in which the sprayhead is spaced apart from the spout. The faucet also includes a hose that includes a tubular portion having an inlet end and an outlet end and configured to provide fluid through the spout to the sprayhead and a magnetically responsive end portion coupled to the outlet end and configured to be freely and rotatably received within a portion of the sprayhead. A magnet is located in the spout such that when the sprayhead is in the docked position, the magnet magnetically attracts the magnetically responsive end portion of the hose so as to retain the sprayhead against the spout.

19 Claims, 15 Drawing Sheets

(56) References Cited

U.S. PATENT DOCUMENTS

| | | | |
|---|---|---|---|
| 3,840,041 | A | 10/1974 | McMurray |
| 4,049,295 | A | 9/1977 | Piers |
| 4,205,678 | A | 6/1980 | Adair |
| 4,232,695 | A | 11/1980 | Roberge |
| 4,304,256 | A | 12/1981 | Taiani |
| 4,384,703 | A | 5/1983 | Ruyak et al. |
| 4,427,960 | A | 1/1984 | Wuerfel |
| 4,651,720 | A | 3/1987 | Baus |
| 4,671,486 | A | 6/1987 | Giannini |
| 4,716,922 | A | 1/1988 | Camp |
| 4,718,131 | A | 1/1988 | Kitamura et al. |
| 5,025,510 | A | 6/1991 | Basile |
| 5,096,230 | A | 3/1992 | Pausch et al. |
| 5,277,391 | A | 1/1994 | Haug et al. |
| 5,318,328 | A | 6/1994 | Dawson |
| 5,419,354 | A | 5/1995 | Krynicki |
| 5,645,302 | A | 7/1997 | Horimoto |
| 5,727,769 | A | 3/1998 | Suzuki |
| 5,758,690 | A | 6/1998 | Humpert et al. |
| 5,771,934 | A | 6/1998 | Warshawsky |
| 5,822,811 | A | 10/1998 | Ko |
| 6,023,951 | A | 2/2000 | Maurer et al. |
| 6,034,465 | A | 3/2000 | McKee et al. |
| 6,202,980 | B1 | 3/2001 | Vincent et al. |
| 6,220,297 | B1 | 4/2001 | Marty et al. |
| 6,370,713 | B2 | 4/2002 | Bosio |
| 6,381,770 | B1 | 5/2002 | Raisch |
| 6,387,096 | B1 | 5/2002 | Hyde, Jr. |
| 6,390,717 | B1 | 5/2002 | Bar |
| 6,446,278 | B1 | 9/2002 | Lin |
| 6,594,832 | B2 | 7/2003 | Yang |
| 6,619,567 | B1 | 9/2003 | Ouyoung |
| 6,757,921 | B2 | 7/2004 | Esche |
| 6,786,239 | B1 | 9/2004 | Welsh |
| 6,808,131 | B2 | 10/2004 | Bosio |
| 6,810,539 | B2 | 11/2004 | Bosio |
| 6,845,526 | B2 | 1/2005 | Malek et al. |
| 6,877,172 | B2 | 4/2005 | Malek et al. |
| 6,910,604 | B2 | 6/2005 | Gugliotti et al. |
| 6,915,816 | B2 | 7/2005 | Nelson et al. |
| 6,938,837 | B2 | 9/2005 | Nelson et al. |
| 7,000,854 | B2 | 2/2006 | Malek et al. |
| 7,070,125 | B2 | 7/2006 | Williams et al. |
| 7,104,473 | B2 | 9/2006 | Bosio |
| 7,114,510 | B2 | 10/2006 | Peters et al. |
| 7,150,293 | B2 | 12/2006 | Jonte |
| 7,162,802 | B2 | 1/2007 | Benardeau et al. |
| 7,246,757 | B2 | 7/2007 | Juo |
| 7,252,112 | B1 | 8/2007 | Imler et al. |
| 7,438,768 | B2 | 10/2008 | Sakaki et al. |
| 7,472,433 | B2 | 1/2009 | Rodenbeck et al. |
| 7,487,796 | B2 | 2/2009 | Imler et al. |
| 7,520,105 | B2 | 4/2009 | Geller |
| 7,537,023 | B2 | 5/2009 | Marty et al. |
| 7,563,249 | B2 | 7/2009 | Schriver et al. |
| 7,669,899 | B2 | 3/2010 | Carson |
| 7,699,241 | B2 | 4/2010 | Benstead |
| 7,748,406 | B2 | 7/2010 | Pilatowicz et al. |
| 7,753,079 | B2 | 7/2010 | Nelson |
| 7,793,987 | B1 | 9/2010 | Busch et al. |
| 7,909,061 | B2 | 3/2011 | Nelson |
| 8,104,113 | B2 | 1/2012 | Rodenbeck et al. |
| 8,118,240 | B2 | 2/2012 | Rodenbeck et al. |
| 8,205,846 | B2 | 6/2012 | Glunk |
| 8,387,661 | B2 | 3/2013 | Nelson |
| 8,496,028 | B2 | 7/2013 | Nelson et al. |
| 2001/0011561 | A1 | 8/2001 | Marty et al. |
| 2001/0020302 | A1 | 9/2001 | Bosio |
| 2002/0017239 | A1 | 2/2002 | Di Gioia et al. |
| 2003/0041372 | A1 | 3/2003 | Yang |
| 2004/0135009 | A1 | 7/2004 | Malek et al. |
| 2004/0177880 | A1 | 9/2004 | Nelson et al. |
| 2004/0258567 | A1 | 12/2004 | Kokin et al. |
| 2005/0000702 | A1 | 1/2005 | Shim |
| 2005/0125893 | A1 | 6/2005 | Zhadanov et al. |
| 2005/0132488 | A1 | 6/2005 | Biondo et al. |
| 2005/0189438 | A1 | 9/2005 | Bosio |
| 2006/0130907 | A1 | 6/2006 | Marty et al. |
| 2006/0200903 | A1 | 9/2006 | Rodenbeck et al. |
| 2006/0213585 | A1 | 9/2006 | Nakamura et al. |
| 2006/0283511 | A1 | 12/2006 | Nelson |
| 2007/0001018 | A1 | 1/2007 | Schmitt et al. |
| 2007/0022528 | A1 | 2/2007 | Gilbert |
| 2007/0040380 | A1 | 2/2007 | Benstead |
| 2007/0170284 | A1 | 7/2007 | Nelson et al. |
| 2007/0246267 | A1 | 10/2007 | Koottungal |
| 2007/0246550 | A1 | 10/2007 | Rodenbeck et al. |
| 2007/0246564 | A1 | 10/2007 | Rodenbeck et al. |
| 2007/0277887 | A1 | 12/2007 | Imler et al. |
| 2008/0143098 | A1 | 6/2008 | Zimmermann et al. |
| 2008/0178957 | A1 | 7/2008 | Thomas et al. |
| 2008/0185060 | A1 | 8/2008 | Nelson |
| 2008/0196160 | A1 | 8/2008 | Alder et al. |
| 2008/0223454 | A1 | 9/2008 | Pilatowicz et al. |
| 2008/0283083 | A1 | 11/2008 | Piao |
| 2009/0007330 | A1 | 1/2009 | Genord et al. |
| 2009/0039176 | A1 | 2/2009 | Davidson et al. |
| 2009/0120516 | A1 | 5/2009 | Paini |
| 2009/0146412 | A1 | 6/2009 | Schoenoff et al. |
| 2009/0200794 | A1 | 8/2009 | Esche et al. |
| 2009/0205122 | A1 | 8/2009 | Biondo et al. |
| 2009/0302181 | A1 | 12/2009 | Glunk |
| 2010/0043135 | A1 | 2/2010 | Patterson et al. |
| 2010/0170587 | A1 | 7/2010 | Kaess |
| 2010/0170588 | A1 | 7/2010 | Nelson |
| 2010/0212761 | A1 | 8/2010 | Hart |
| 2010/0307497 | A1 | 12/2010 | Busch et al. |
| 2011/0162743 | A1 | 7/2011 | Nelson |
| 2012/0097874 | A1 | 4/2012 | Rodenbeck et al. |

FOREIGN PATENT DOCUMENTS

| | | |
|---|---|---|
| CN | 201776197 | 3/2011 |
| CN | 202527291 | 11/2012 |
| CN | 202546003 | 11/2012 |
| CN | 202691206 | 1/2013 |
| DE | 14 89 255 | 8/1969 |
| DE | 40 00 621 | 7/1991 |
| DE | 93 00 418 | 3/1993 |
| DE | 196 49 006 | 5/1998 |
| DE | 201 17 761 | 2/2002 |
| DE | 202 11 780 | 9/2002 |
| DE | 102 60 207 | 6/2004 |
| EP | 0 910 32 | 10/1983 |
| EP | 1 201 836 | 5/2002 |
| EP | 1 367 183 | 12/2003 |
| EP | 1 350 895 | 2/2006 |
| EP | 2 042 663 | 4/2009 |
| EP | 2378011 | 10/2011 |
| FR | 2197395 | 3/1974 |
| GB | 1 303 959 | 1/1973 |
| GB | 2 285 919 | 8/1995 |
| GB | 2 397 519 | 7/2004 |
| GB | 2 431 861 | 5/2007 |
| JP | 05-148868 | 6/1993 |
| JP | 06-043069 | 6/1994 |
| JP | 2000-263060 | 9/2000 |
| JP | 2002-068270 | 3/2002 |
| JP | 2002-223969 | 8/2002 |
| JP | 2005-090099 | 4/2005 |
| JP | 2007-262838 | 10/2007 |
| JP | 2009-028140 | 2/2009 |
| JP | 06-046929 | 2/2010 |
| NL | 1028853 | 10/2006 |
| WO | WO-92/04509 | 3/1992 |
| WO | WO-2005/026457 | 3/2005 |
| WO | WO-2005/098150 | 10/2005 |
| WO | WO-2007/019718 | 2/2007 |
| WO | WO-2008/107101 | 9/2008 |
| WO | WO-2008/107102 | 9/2008 |

(56) References Cited

FOREIGN PATENT DOCUMENTS

| | | |
|---|---|---|
| WO | WO-2008/107103 | 9/2008 |
| WO | WO-2010/021765 | 2/2010 |

OTHER PUBLICATIONS

Grohe Product Catalog pages, Stainless Steel Pull-Out Spray, 2004, 4 pages.

Latoscana Elba Kitchen Faucet with Magnetic Spray, Brushed Nickel Finish, Model 78PW557PMEX, retrieved from www.thehomedepot.com prior to May 3, 2007, 2 pages.

Latoscana Elba Kitchen Faucet with Magnetic Spray, Model 78CR557M, Design Specifications, retrieved from www.latoscanacollection.com prior to May 3, 2007, 3 pages.

Latoscana Elba Kitchen Faucet with Magnetic Spray, Model 78CR557PMEX, retrieved from www.thehomedepot.com prior to May 3, 2007, 2 pages.

MAGNETIC DOCKING FAUCET

CROSS REFERENCE TO RELATED APPLICATIONS

This application is a continuation-in-part of U.S. patent application Ser. No. 13/787,262, filed Mar. 6, 2013, which claims priority from U.S. Provisional Patent Application 61/676,711, filed Jul. 27, 2012, each of which is incorporated herein by reference in its entirety.

BACKGROUND

The present application relates generally to the field of faucets. More specifically, the present application relates to systems and methods for releasably coupling a pullout sprayhead to a faucet body.

Some faucets, kitchen faucets in particular, employ a sprayhead attached to a flexible hose. When not needed, the sprayhead is typically docked into an end of a spout. Conventional methods for retaining the sprayhead in the spout include counterweights, mechanical snaps, compression fittings, and compression springs. U.S. Pat. No. 7,753,079 discloses using a magnet attached to each of the sprayhead and the end of the spout to retain the sprayhead therein. Counterweights may be noisy or come to rest on pipes or other items under the sink. Mechanical snaps and compression fit systems may wear over time. Compression springs may be noisy and tend to have a high retraction force when the sprayhead is fully extended and a low retraction force when the sprayhead is docked. Magnets in the sprayhead and at the end of the spout are often limited in size or drive the shape of the spout outlet, limiting aesthetic design options. Accordingly, there is a need for an improved docking system for releasably coupling a pullout sprayhead to a faucet body.

SUMMARY

One embodiment relates to a faucet that includes a spout and a sprayhead movable between a docked position, in which the sprayhead is in contact with the spout, and an undocked position, in which the sprayhead is spaced apart from the spout. The faucet also includes a hose that includes a tubular portion having an inlet end and an outlet end and configured to provide fluid through the spout to the sprayhead and a magnetically responsive end portion coupled to the outlet end and configured to be freely and rotatably received within a portion of the sprayhead. A magnet is located in the spout such that when the sprayhead is in the docked position, the magnet magnetically attracts the magnetically responsive end portion of the hose so as to retain the sprayhead against the spout.

Another embodiment relates to a faucet that includes a sprayhead, a spout, and a hose assembly. The hose assembly includes a hose passing through the spout, the hose having a first end for receiving fluid from a fluid source and a second end for providing the fluid to the sprayhead, a ball rotatably coupled to the sprayhead, and a magnetically responsive ferrule securing the ball to the second end of the hose. A magnet is located in the spout and configured such that when the sprayhead is brought toward the spout, the ferrule magnetically couples to the magnet, thereby generating sufficient magnetic force upon the ferrule to retain the sprayhead against the spout.

Another embodiment relates to a faucet that includes a spout extending from a first end to a second end, a sprayhead consisting of predominantly non-magnetically responsive components, comprising a socket, and movable between a docked position, in which the sprayhead is in contact with the second end of the spout, and an undocked position, in which the sprayhead is spaced apart from the spout, and a hose assembly. The hose assembly includes a hose passing through the spout, the hose having an inlet end for receiving fluid from a fluid source and an outlet end for providing the fluid to the sprayhead, and a magnetically responsive end portion fixed to the outlet end of the hose, the magnetically responsive end portion comprising a ball rotatably received in the socket of the sprayhead and a magnetically responsive collar that fixes the ball to the hose. A docking assembly is located in the spout proximate the second end, and includes a retainer having an axially-extending, first sidewall defining a bore allowing the hose assembly to pass therethrough, and a magnet defining an aperture allowing the first sidewall of the retainer to pass therethrough, wherein when the sprayhead is in the docked position, the magnet magnetically couples to the magnetically responsive end portion of the hose, thereby applying sufficient magnetic force to the hose to retain the sprayhead against the spout.

Another embodiment relates to a faucet having a spout and a sprayhead releasably coupled to the spout. A hose having a magnetically responsive collar thereon provides fluid through the spout to the sprayhead. A magnet is located in the faucet such that when the sprayhead is coupled to the spout, the collar magnetically couples to the magnet, thereby applying sufficient magnetic force to the hose to retain the sprayhead against the spout.

Another embodiment relates to a faucet having a sprayhead releasably supported by a spout, a hose passing through the spout, a magnetically responsive collar coupled to the hose, and a magnet. The hose has a first end for receiving fluid from a fluid source and a second end fluidly coupled to the sprayhead. The magnet is located in the faucet such that when the sprayhead is supported by the spout, the collar magnetically couples to the magnet, thereby applying sufficient magnetic force to the hose to retain the sprayhead against the spout.

Another embodiment relates to an apparatus for a releasably retaining a hose relative to a body. The apparatus includes a magnet defining an opening passing axially therethrough, a retainer having a sidewall extending axially through the opening of the magnet, the sidewall defining a bore, and a hose passing through the bore of the retainer. The hose includes a magnetically responsive collar coupled to the hose, an extracted position, in which the collar and the magnet magnetically decouple, and a refracted position, in which the collar and the magnet magnetically couple and the collar is located at least partially in the opening of the retainer.

The foregoing is a summary and thus by necessity contains simplifications, generalizations and omissions of detail. Consequently, those skilled in the art will appreciate that the summary is illustrative only and is not intended to be in any way limiting. Other aspects, inventive features, and advantages of the devices and/or processes described herein, will become apparent in the detailed description set forth herein and taken in conjunction with the accompanying drawings.

DETAILED DESCRIPTION

Referring generally to the FIGURES, a faucet having a magnetic docking system and components thereof are shown according to an exemplary embodiment. The faucet includes a body, a spout, and a sprayhead releasably coupled to the spout. A hose carries fluid through the spout to the sprayhead, where the fluid is ejected (e.g., released, sprayed, output) to the environment, for example, into a basin, sink, tub, or shower stall.

Figure 1:
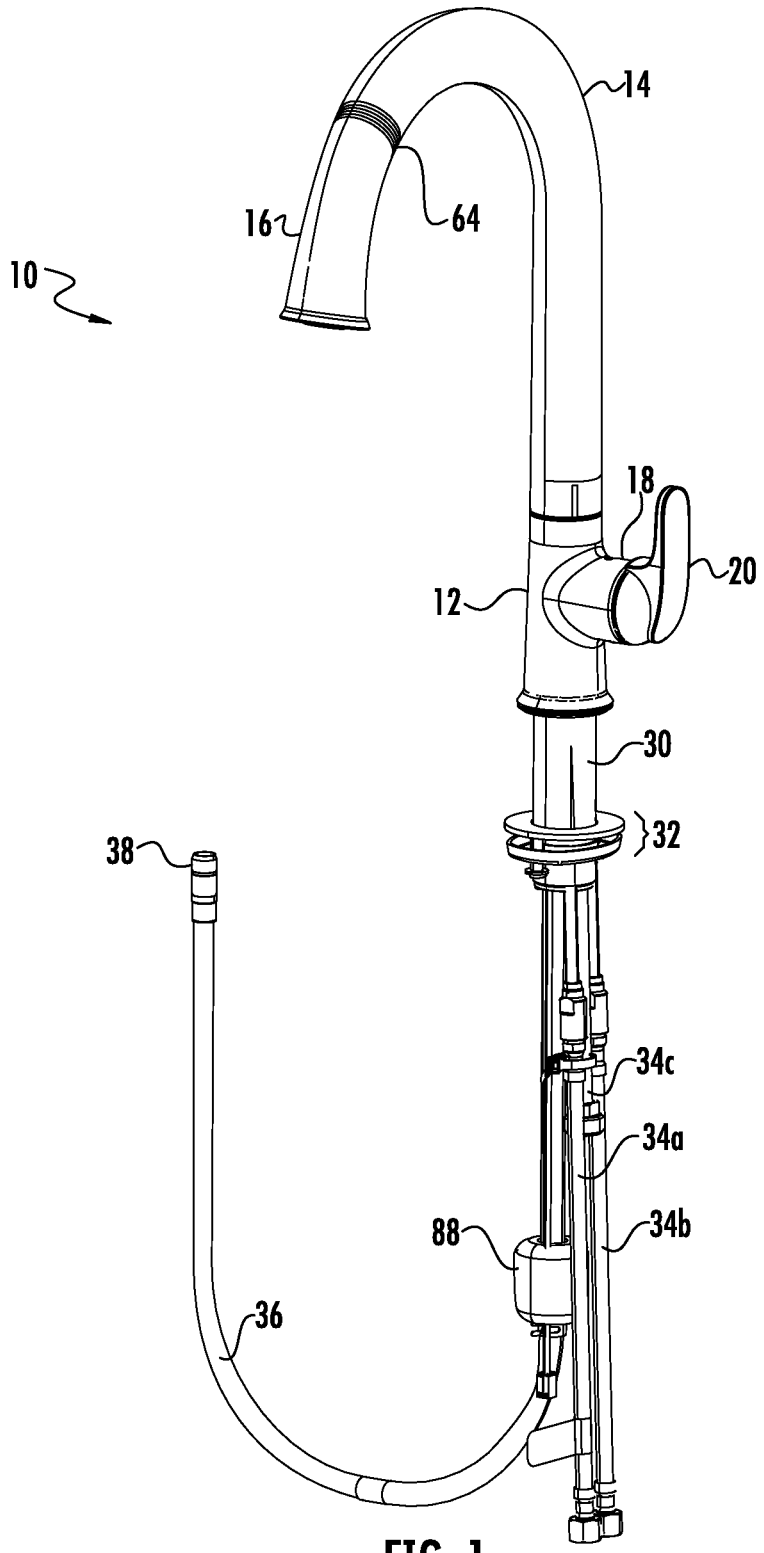
FIG. 1 is a top, front, right perspective view of a faucet, shown according to an exemplary embodiment.
Figure 2:
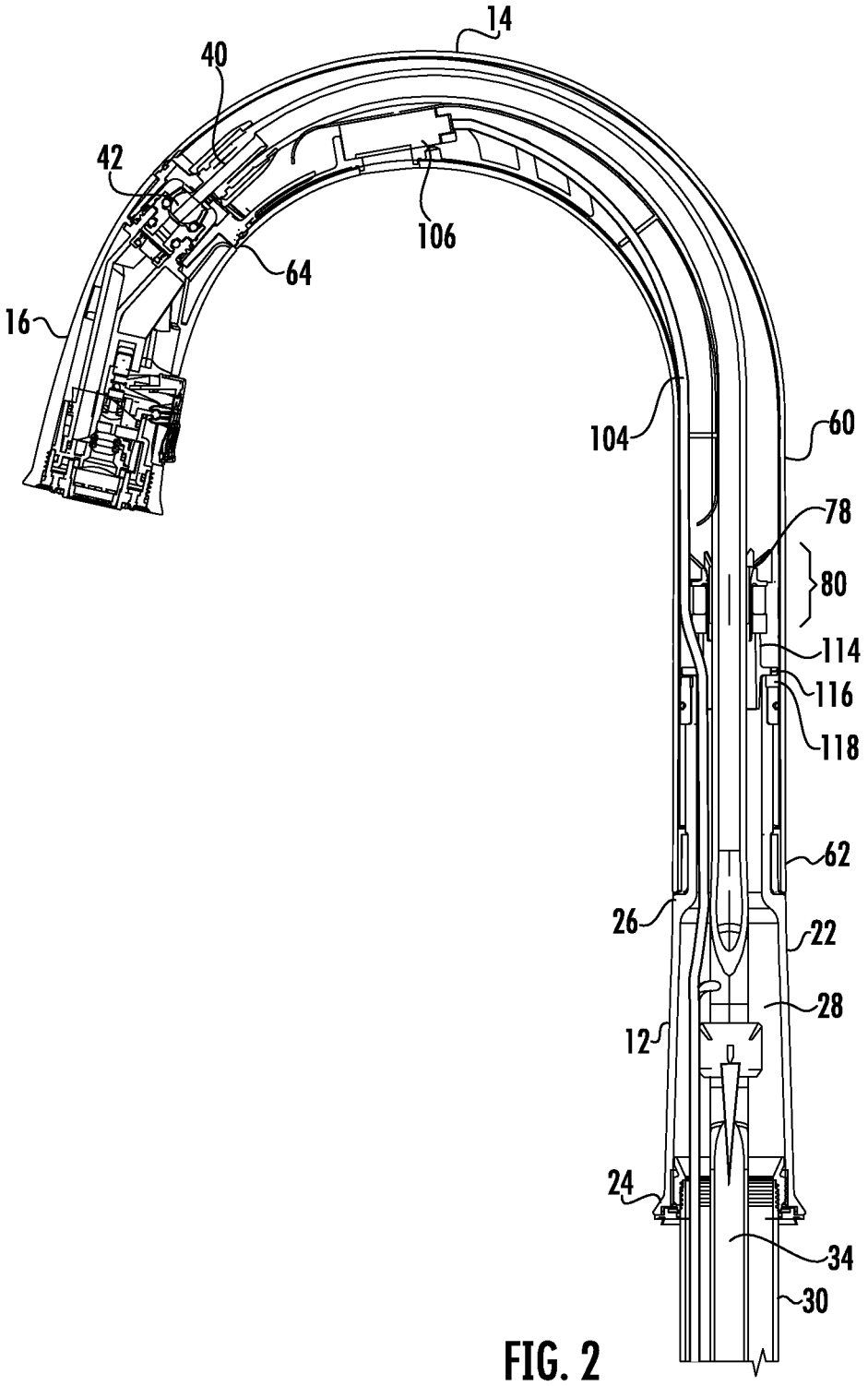
FIG. 2 is a right side elevational cross-section view of the faucet of FIG. 1, shown according to an exemplary embodiment.
Figure 7:
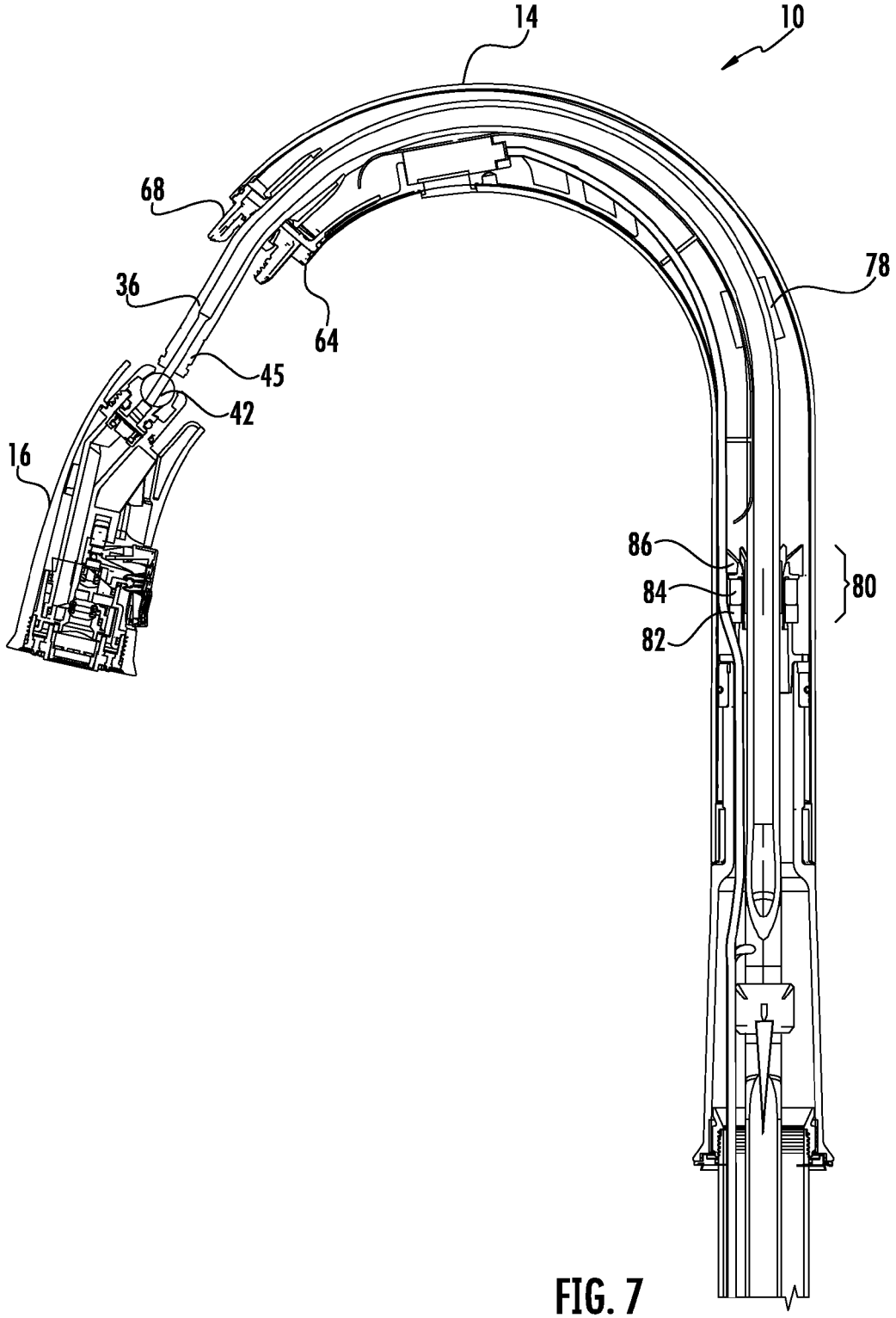
FIG. 7 is a right side elevational cross-section view of the faucet of FIG. 1, shown according to an exemplary embodiment.

The faucet shown in FIGS. 1 and 2 is shown in a first or docked position, in which the sprayhead is coupled to the spout. The faucet shown in FIG. 7 is shown in a second or undocked position. In the undocked position, the sprayhead is decoupled and spaced apart from the spout. In such a position, the hose is at least partially extracted from the spout. According to the embodiments shown, a magnetized docking assembly is located in the spout, and a magnetically responsive collar is coupled to the hose.

As the sprayhead is returned to the docked position, the docking assembly magnetically couples to and attracts the collar on the hose. According to the embodiment shown, the distance from the collar to the sprayhead is slightly less than the distance from the magnet to the end of the spout. Accordingly, the magnetic force of the docking assembly holds the sprayhead against the spout, thereby preventing the sprayhead from drooping from the spout end, which may be aesthetically unappealing. Further, the pull of the docking assembly transmitted, through the sprayhead to the user, provides the user a tactile feedback that the sprayhead is docked.

While the docking system herein is described with respect to a faucet, is contemplated that the docking system may be applied to any configuration that requires a hose, cable, rod, or line (e.g., rope, etc.) that needs to be temporarily held in position with or without tension, for example, water hoses for gardening or greenhouses, air hoses for industrial applications, hand held shower hose applications, halyards for banners or flagpoles, (electrical) extension cord coils, control devices, push/pull control rods, etc.

Before discussing further details of the faucet and/or the components thereof, it should be noted that references to "front," "back," "rear," "top," "bottom," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or, alternatively, may be removable or releasable in nature.

Referring to FIGS. 1 and 2, a faucet and components thereof are shown, according to an exemplary embodiment. A faucet 10 includes a base 12, a spout 14, and a sprayhead 16 releasably coupled to the spout 14. The faucet 10 is shown to include an arm 18 is configured to house and support a manual valve (not shown). The valve may be configured to control the volume, temperature, or some combination thereof, of the fluid (e.g., water, beverage, etc.) flow through the faucet. A handle 20 is coupled to the valve to control the operation thereof. According to other embodiments, the faucet 10 may not include an arm 18, and the valve and handle 20 may be located remotely from the faucet 10. According to various other embodiments, the faucet 10 may include an electronically controlled valve (e.g., solenoid valve) in addition to, or instead of, the manual valve.

The base 12 includes a sidewall 22, extending between a first or bottom end 24 to a second or top end 26, and an axially extending cavity 28. The bottom end 24 is configured to provide stable support to the faucet 10 when coupled to a surface (e.g., countertop, wall, bar, table, support structure, etc.). A stem 30 may be threadedly coupled to the bottom end 24 to extend through the surface and to couple to a clamping mechanism 32 configured to couple the stem 30 to an opposite side (e.g., underside, inside, etc.) of the surface.

The sidewall 22 is shown to at least partially define the cavity 28, which is configured to receive and permit the passage therethrough of water lines 34. For example, the cavity 28 is shown to receive a cold water line 34*a* and a hot water line 34*b*. According to the exemplary embodiment shown, the faucet 10 further includes an intermediary line 34*c*

(e.g., jumper line, patch line, etc.), which extends between the manual valve and an electronically controlled valve (not shown).

Figure 3:
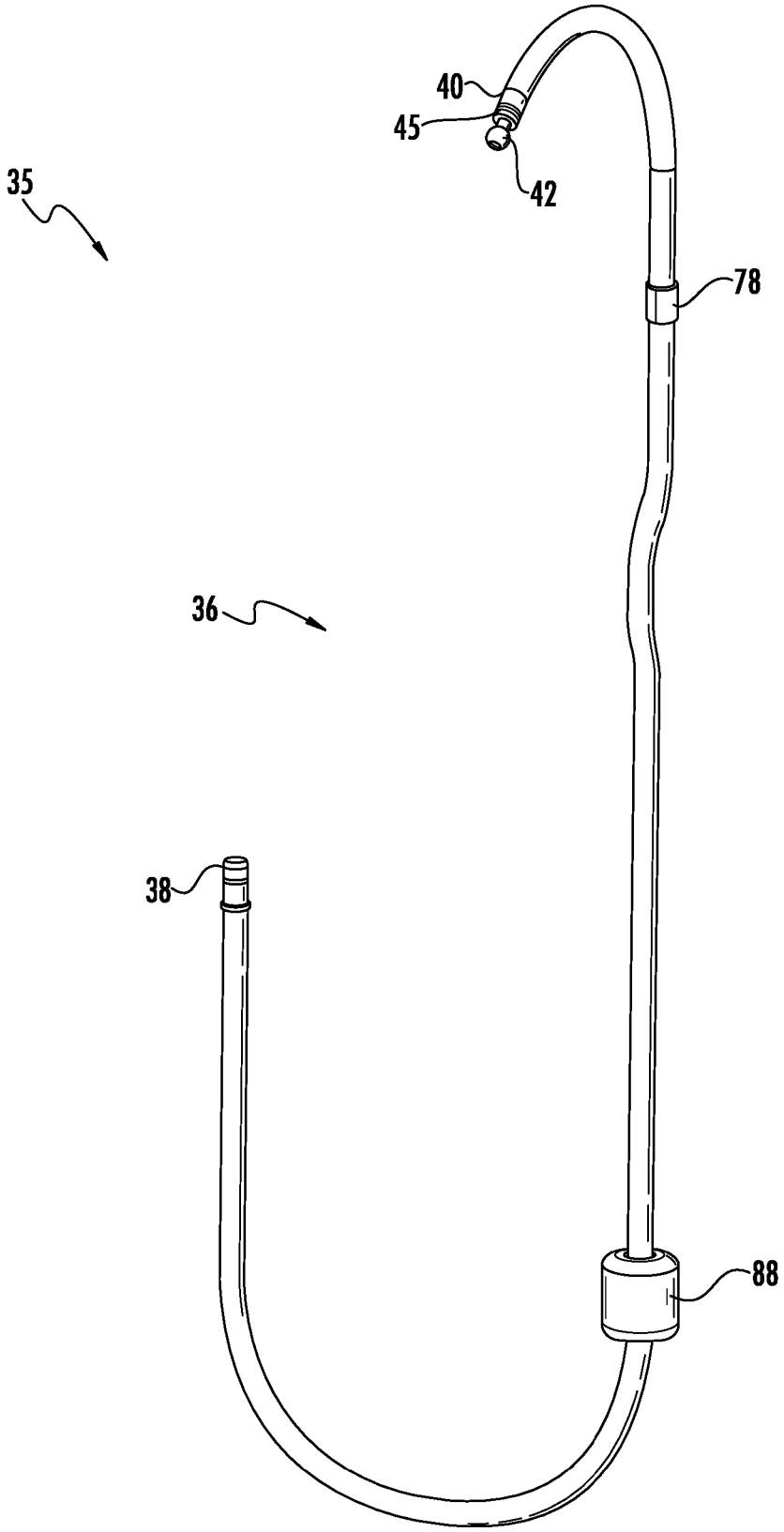
FIG. 3 is a perspective view of components of the faucet of FIG. 1, shown according to an exemplary embodiment.

Further referring to FIG. 3, the faucet 10 further includes a hose assembly 35 having an outlet line, shown as hose 36, according to an exemplary embodiment. The hose 36 is configured to carry water through the spout 14 to the sprayhead 16 and is sufficiently flexible to permit the hose to travel through the shape of the spout 14 while the sprayhead 16 is moved between the docked and undocked positions. The hose 36 is preferably substantially inelastic in an axial direction to facilitate operation of the magnetic docking system. According to the exemplary embodiment shown, the hose 36 extends from a first or inlet end 38, which couples to the electronically controlled valve, to a second or outlet end 40, which couples to the sprayhead 16. According to another embodiment, the faucet 10 may not include an electronically controlled valve, in which case, the inlet end 38 of the hose 36 couples to the intermediary line 34*c*. The hose 36 further includes an end portion, shown as ball 42, coupled to the outlet end 40. The ball 42 is shown to include a member, shown as stem 43, extending into the hose 36. The ball 42 may be secured to the hose 36 via a clamp, shown as ferrule 45, that may be crimped or swaged onto the hose 36 and stem 43.

Figure 4:
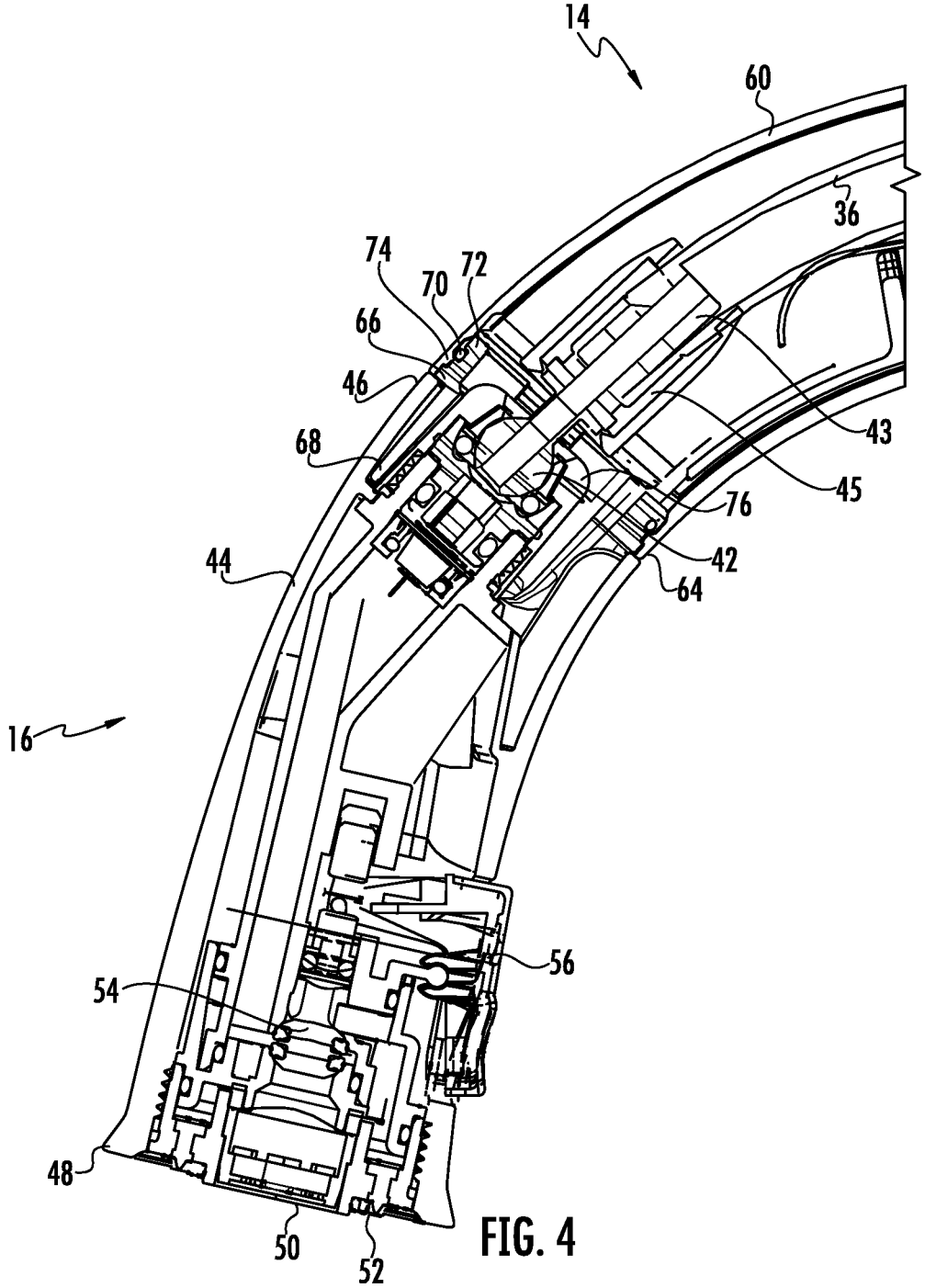
FIG. 4 is a right side elevational cross-section view of an enlarged portion of the faucet of FIG. 1, shown according to an exemplary embodiment.

Further referring to FIG. 4, the sprayhead 16 includes a sidewall 44 extending between a first or inlet end 46 and a second or outlet end 48. The sprayhead 16 transfers fluid from the hose 36 to an outlet port. For example, the sprayhead 16 may include an aerator 50 and one or more non-aerated nozzles 52. A diverter mechanism 54 controlled by a switch 56 may transition the flow between modes, e.g., divert flow to the aerator 50 or to the nozzles 52. According to various embodiments, the switch 56 may be configured to pause the flow of fluid through the sprayhead 16, or the sprayhead 16 may include a pause button configured to pause the flow of fluid instead of, or in addition to, the switch 56 configured to transition flow between modes.

The spout 14 includes a sidewall 60 extending from a first or bottom end 62 to a second or top end 64. The bottom end 62 couples to the top end 26 of the base 12. According to other embodiments, the spout 14 may be fixed to the base 12, but according to the embodiment shown, the spout 14 is rotatably coupled to the base 12 to provide direction and range of the outlet flow of fluid to the environment, i.e., provides a greater usable work area. The top end 64 is configured to releasably couple to the sprayhead 16.

According to the embodiment shown, the spout 14 includes a sprayhead support 66 coupled to the top end 64 of the spout 14. The sprayhead support 66 includes an at least partially annular flange 68 extending axially from the top end 64 and into the sprayhead 16 when the sprayhead 16 is in the docked position. The sprayhead support 66 helps to retain the sprayhead 16 in the docked position. For example, as shown, the annular flange 68 provides support to an inner portion of the sidewall 44 to resist shear forces and to align the inlet end 46 of the sprayhead 16 with the top end 64 of the spout 14. The sprayhead support 66 further provides visual and tactile cues to a user attempting to dock the sprayhead 16. The sprayhead support 66 may be threaded, press fit, or snapped into the spout 14. According to the embodiment shown, the sprayhead support 66 is retained in the spout 14 by a resilient member 70 (e.g., o-ring, snap ring, etc.) that is trapped between an outwardly extending ledge 72 on the sprayhead support 66 and an inwardly extending ledge 74 on the sidewall 60. According to other embodiments, the sprayhead support may be radially outward of (e.g., circumscribe) the sprayhead 16 and receive the sprayhead 16 therein, the sprayhead support may be coupled to the sprayhead 16 and extend into or around the top end 64 of the spout 14, or the faucet 10 may not include a sprayhead support 66.

As shown, the sprayhead 16 further includes a socket 76 proximate the inlet end 46 and configured to receive and retain ball 42 of the hose 36. According to the exemplary embodiment shown, the socket 76 is threadedly coupled to the sprayhead 16 after the hose 36 is passed through the socket 76. According to other embodiments, the socket 76 may be coupled to the sprayhead 16, and the ball 42 is then pressed or snapped into the socket 76.

Referring to FIGS. 1 and 2, the faucet 10 is shown in a first or docked position, and further referring to FIG. 7, the faucet 10 is shown in a second or undocked position, according to an exemplary embodiment. In the docked position, the sprayhead 16 is coupled to the top end 64 of the spout 14. In the undocked position, the sprayhead 16 is decoupled and spaced apart from the spout 14. In such a position, the hose 36 is at least partially extracted from the spout 14.

Figure 5:
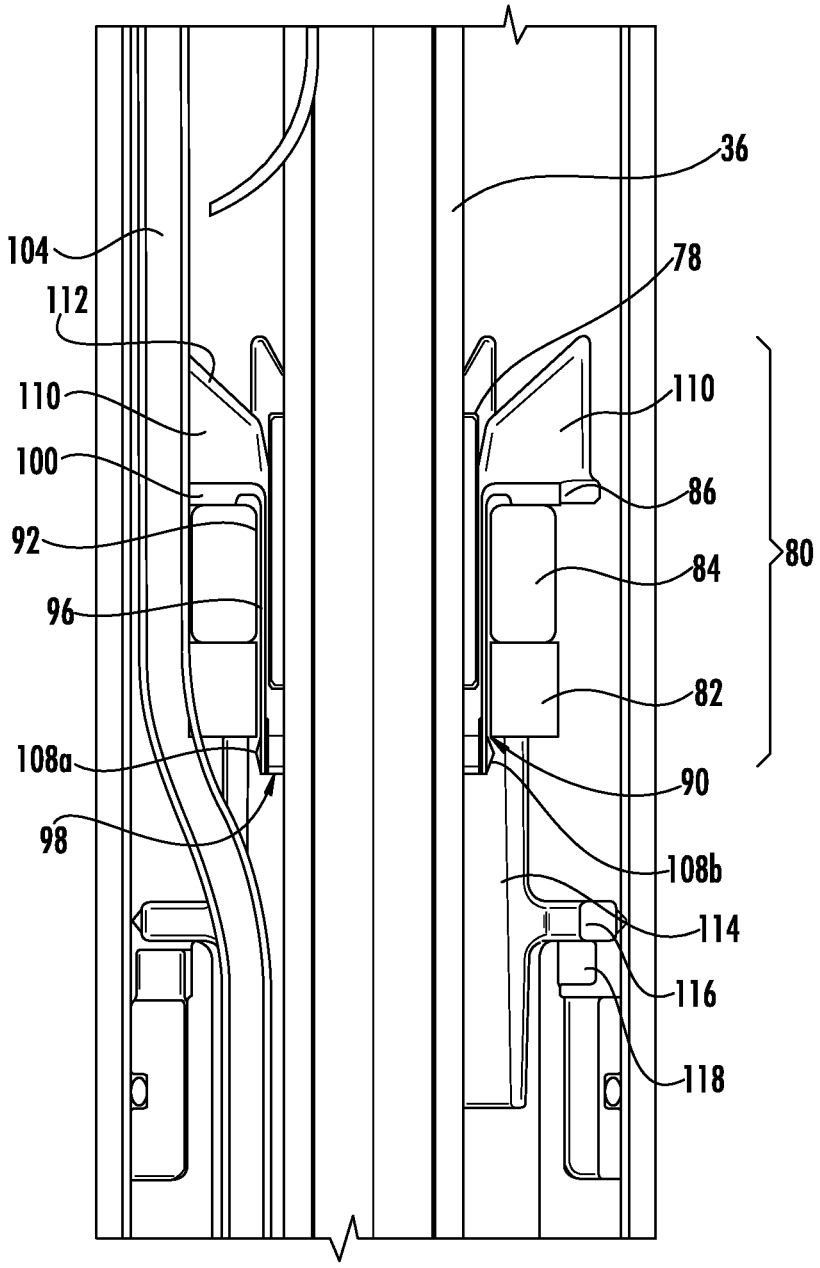
FIG. 5 is a right side elevational cross-section view of another enlarged portion of the faucet of FIG. 1, shown according to an exemplary embodiment.
Figure 14:
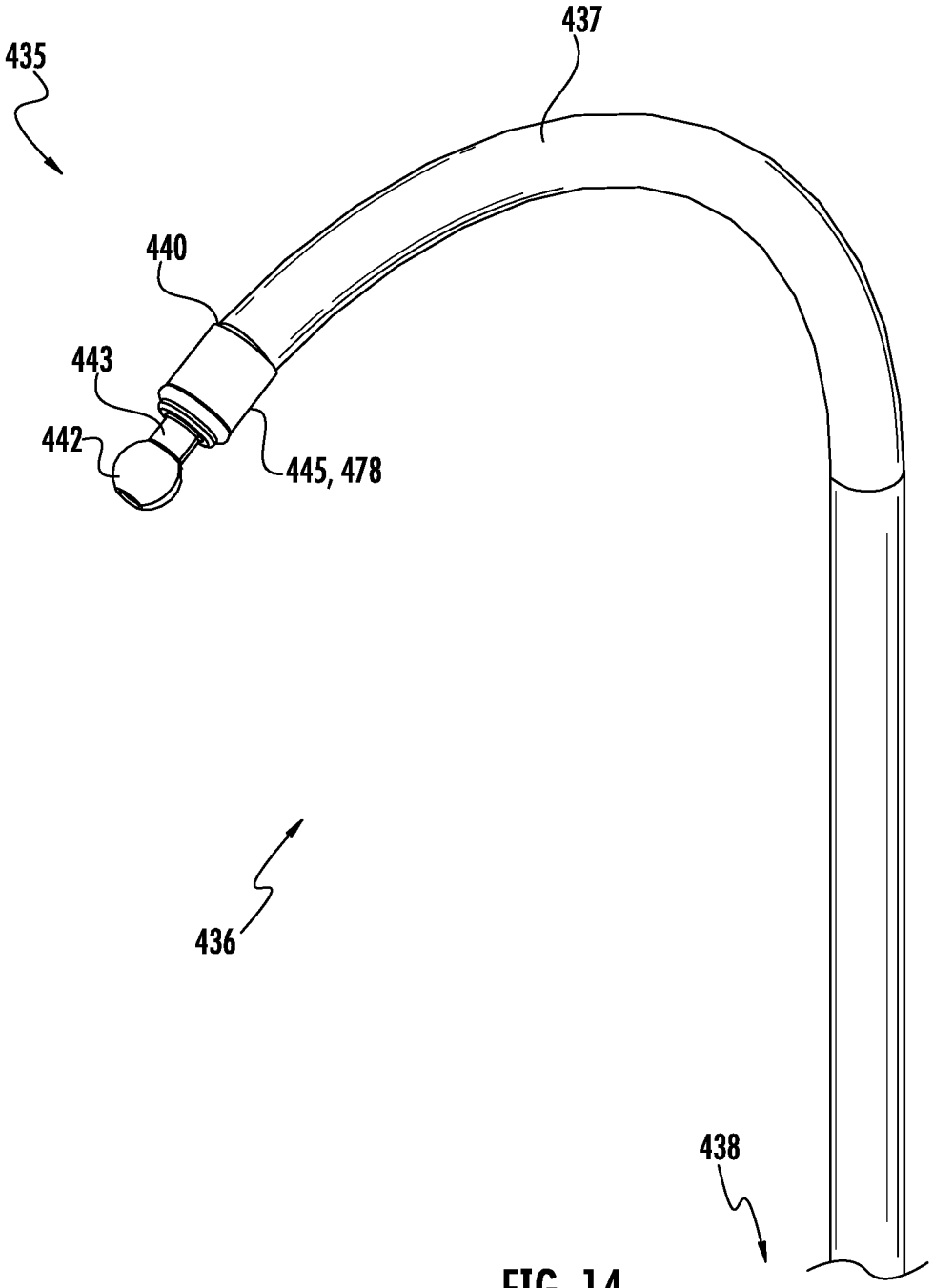
FIG. 14 is a perspective view of components of the faucet of FIG. 13, shown according to an exemplary embodiment
Figure 15:
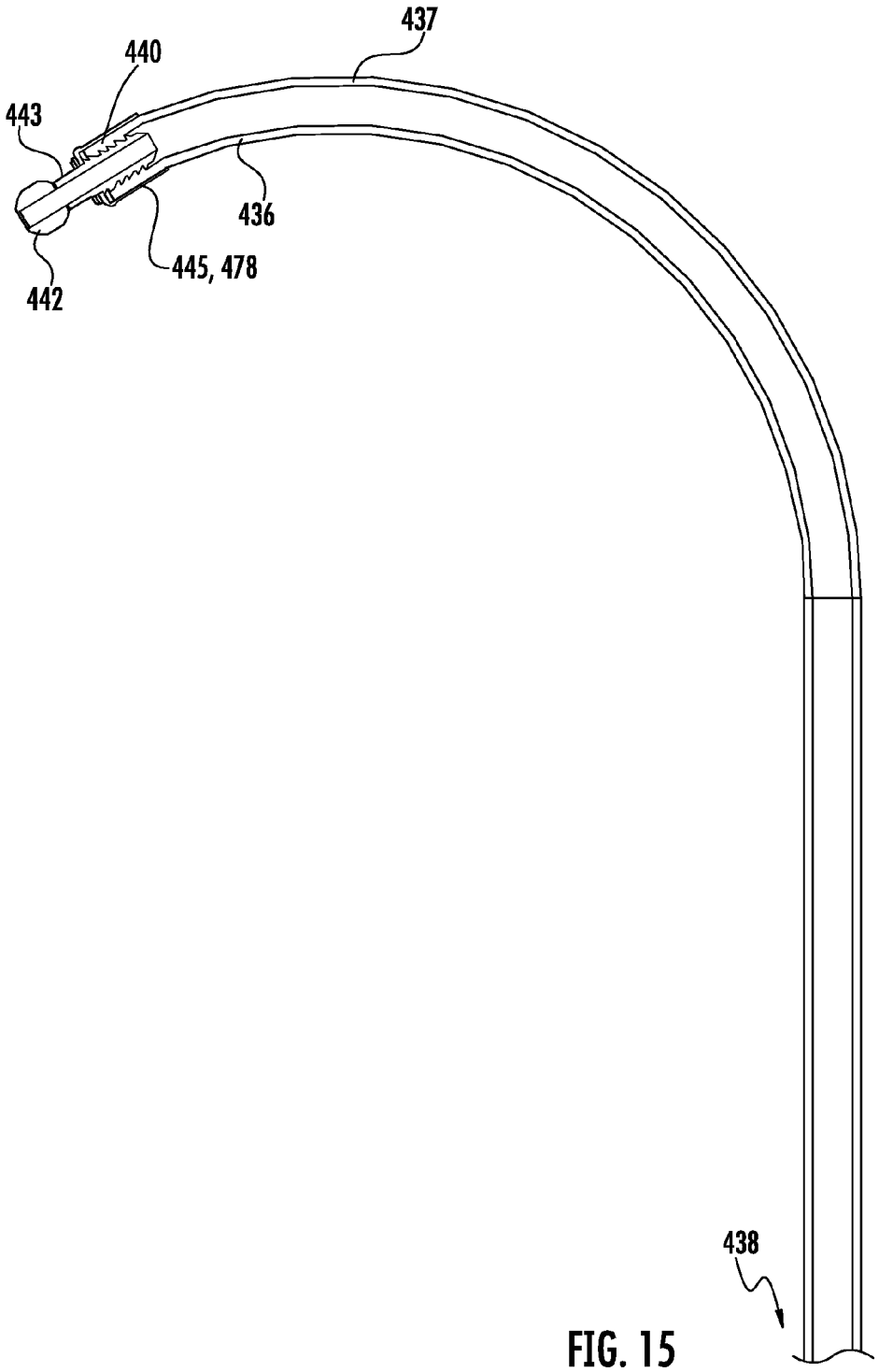
FIG. 15 is a right side elevational cross-section view of an enlarged portion of the components of FIG. 14, shown according to an exemplary embodiment.

Referring to FIG. 5, an enlarged portion of the exemplary embodiment of FIG. 2 is shown. A collar 78 is coupled to hose 36, according to an exemplary embodiment. According to one embodiment, the collar 78 is spliced into the hose 36. According to another embodiment, the collar 78 is "C" shaped collar that may be crimped onto the hose 36. According to another embodiment, the collar 78 is tubular and is crimped onto the hose 36 in position, for example, after being placed over the end of the hose 36 during assembly. According to yet another embodiment, the collar 78 may be coupled to one or more portions of the hose 36. For example, the collar 78 may join two portions of the hose 36, for example, by threading, crimping, a quick disconnect system, etc., to end portions of each of the hoses. According to one embodiment, the collar 78 may be or include the ferrule 45. For example, the collar 78 may be used to secure the stem 43 to the hose 36. Referring briefly to FIGS. 14-15, the collar 78 (e.g., collar 478) may be used to secure the ball 42 (e.g., ball 442) to the hose 36 (e.g., hose 436) such that the collar and ball are supported by and coupled to the hose. The collar and hose may be separated from and move freely relative to both the sprayhead and spout. According to another embodiment, the collar 78 may be coupled to the ferrule 45. The collar 78 may be made of any suitable magnetically responsive material (e.g., iron, steel, etc.). According to the exemplary embodiment shown, the collar 78 is formed of magnet grade stainless steel, i.e., stainless steel having high iron content.

The faucet 10 includes a docking assembly 80, which includes a magnet 82 and may include a field expander, shown as washer 84, and a retainer 86. When the sprayhead 16 is in the docked position, the collar 78 on the hose 36 is positioned proximate the docking assembly 80, and the magnet 82 magnetically couples to and attracts the collar 78. When the sprayhead 16 is moved to the undocked position, the hose 36 is partially extracted from the spout 14, and the collar 78 is moved away from the magnet 82, as shown in FIG. 7. During normal use, the collar 78 is moved sufficiently remote from the magnet 82 that the collar 78 and the magnet 82 magnetically decouple (i.e., magnetic field is sufficiently weak that the magnetic force applied to the collar 78 is negligible).

As the sprayhead 16 is returned to the docked position, the magnetic field from the magnet 82 couples to and attracts the collar 78. According to the embodiment shown, the distance from the collar 78 to the sprayhead 16 is slightly less than the distance from the magnet 82 to the end of the spout 14. Accordingly, magnetic force of the docking assembly 80 holds the sprayhead 16 against the end of the spout 14, thereby preventing the sprayhead from drooping, which may be aesthetically unappealing.

A weight 88 (shown in FIGS. 1 and 3) may be coupled to the hose 36 to help balance the sprayhead 16 and to retract the hose 36 into the spout 14. The weight 88 may be less massive than a conventional weight because the weight 88 need not retain the entire weight of the sprayhead 16 in the docked position. For example, the weight 88 may only compensate for the weight of the hose 36 as it is being fed into the spout 14 while the sprayhead 16 is being returned to the docked position since the docking assembly 80 provides the force necessary to retain the sprayhead 16 in the docked position. According to another embodiment, conventional weight may be used to retract the sprayhead 16 back to the spout, i.e., the faucet 10 would have a "self-retracting" sprayhead 16.

The magnet 82 is shown to have an annular shape having a bore 90 (e.g., aperture, opening, cavity, etc.) to permit the hose 36 to pass therethrough. The magnet 82 may be a permanent magnet, for example, formed of iron, nickel, cobalt, a rare earth element, etc. According to the exemplary embodiment, the magnet 82 is formed of neodymium (e.g., neodymium, neodymium alloy, neodymium-iron-boron, etc.). According to the exemplary embodiment, the docking assembly 80 is located in a portion of the faucet 10 having more available space than the top end 64 of the spout 14. Accordingly, the docking assembly 80 may include a larger, less magnetically dense, lower cost magnet 82. The docking assembly 80 may include magnets of various number, composition, shape, and size to provide customized performance for a given application. As will be described in detail below, the magnetic field from the magnet 82 is configured to selectively couple to the collar 78 to retain the sprayhead 16 in the docked position.

According to other embodiments, the magnet 82 may be an electromagnet. Using an electromagnet allows calibration or adjustment of the force required to decouple the sprayhead 16 from the spout 14. For example, the user may be able to reduce the strength of the magnetic field to facilitate undocking of the sprayhead 16. Another user may increase the strength of the magnetic field to inhibit unwanted undocking of the sprayhead 16, for example, by a child. According to another embodiment, a controller may receive a signal from a touch sensor (e.g., capacitive sensor) that a user has touched the sprayhead 16. The controller may then reduce or remove power from the electromagnet, thereby enabling easy removal of the sprayhead 16 from the spout 14. The controller may then increase or restore power to the electromagnet when the controller receives a signal from the touch sensor that the user is no longer touching the sprayhead 16, for example, when the sprayhead 16 has been returned to the docked position.

Figure 8B:
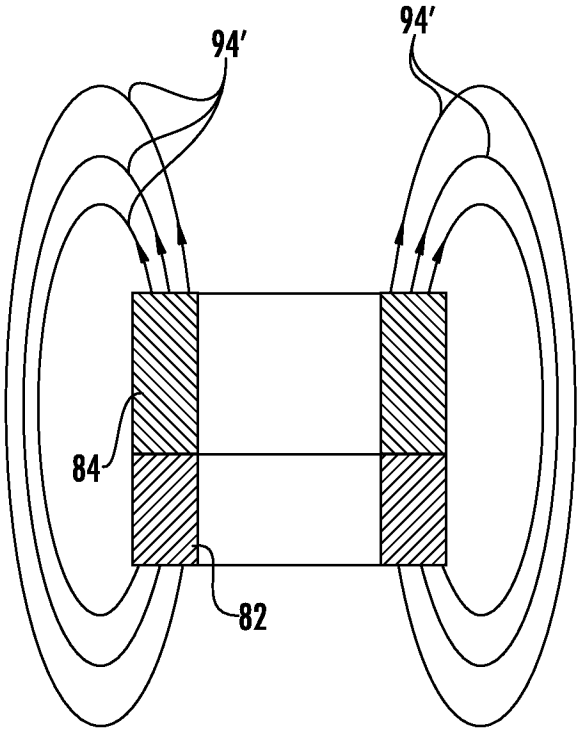
FIGS. 8A and 8B are schematic diagrams of a magnet of FIG. 1, shown according to an exemplary embodiment.
Figure 8A:
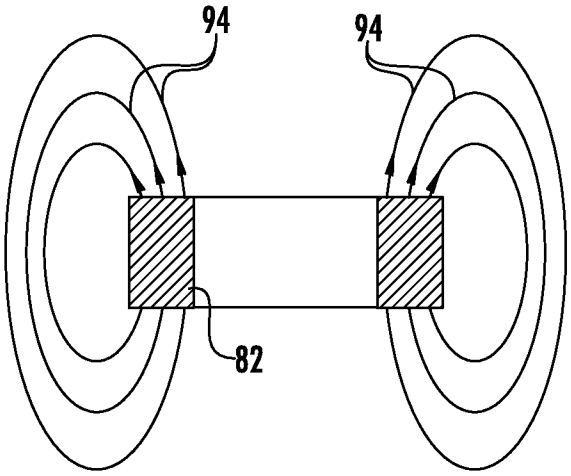
Figure 10:
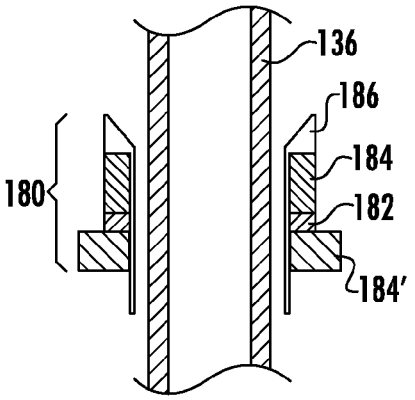
FIG. 10 is a schematic cross-section view of components of a docking system, shown according to another exemplary embodiment.

The docking assembly 80 may further include a washer 84, configured to expand or elongate the magnetic field created by the magnet 82. The field expander may be formed of any suitable material, for example, iron, steel, etc. As shown, the washer 84 has an annular shape having a bore 92 (e.g., aperture, opening, cavity, etc.) to permit the hose 36 pass therethrough. Referring to FIG. 8A, a schematic diagram of the magnet 82 and its flux lines 94 shows that the magnetic field extends a first distance from the magnet. Referring to FIG. 8B, a schematic diagram of the flux lines 94' of the magnet 82 as affected by the washer 84 shows that the washer 84 conducts the magnetic field to elongate or expand the field in an axial direction. Referring to FIG. 10, various numbers, sizes, shapes, and compositions of the washers 84 may be used to provide customized performance for various applications. As shown, the docking assembly 180 includes a retainer 186, a magnet 182, a first field expander 184 located on a first side of the magnet 182, and a second field expander 184' located on a second side of the magnet 182. The customized size, shape, and strength of the field may be used to attract a collar (not shown) coupled to the line or hose 136.

Figure 6:
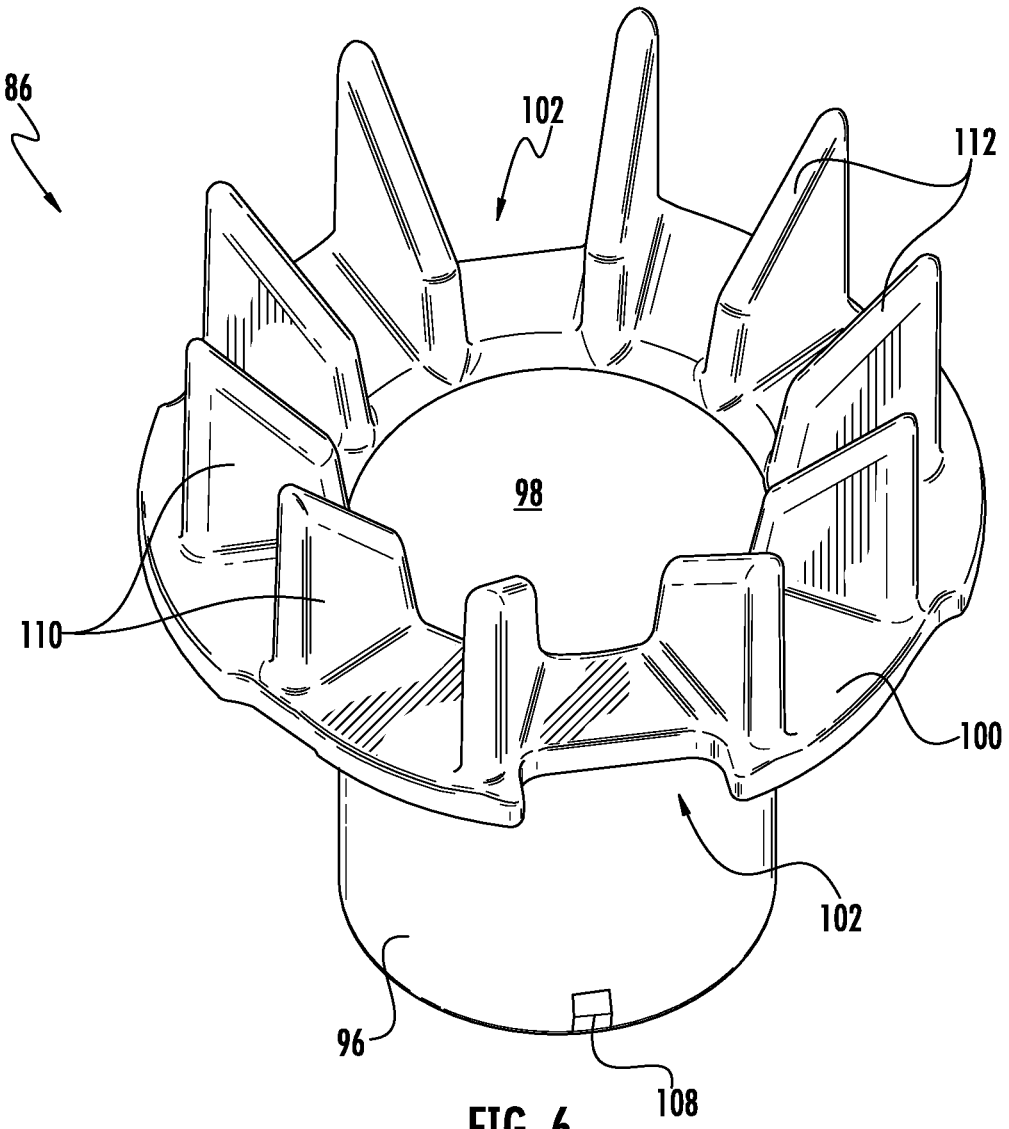
FIG. 6 is a perspective view of a component of the faucet of FIG. 1, shown according to an exemplary embodiment.

Further referring to FIG. 6, the docking assembly 80 may further include a retainer 86 configured to support the magnet 82 and the washer 84. The retainer 86 is shown to include an axially extending sidewall 96 having a first or top end and a second or bottom end axially opposite the first end. The sidewall 96 passes through bore 90 of the magnet 82 and the bore 92 of the washer 84, and in turn the sidewall 96 defines a bore 98 (e.g., aperture, opening, cavity, passageway, etc.) configured to permit collar 78 to pass therethrough. The magnet 82 may be magnetized before or after the magnet 82 is coupled to the retainer 86. A flange 100 extends outwardly from the top end and may define a cutout 102 configured to allow a wire or cable 104 to pass thereby. The cable 104 may carry electrical signals and/or power to or from a sensor 106, which may be used to cause actuation of the electrically controlled valve. At least one boss 108, shown as first boss 108*a*, and second boss 108*b*, may extend outwardly from the bottom end of the retainer 86. The bosses 108 extend radially outwardly beyond the inner diameter of the magnet 82. During assembly, the resilient nature of the boss 108 and/or sidewall 96 may permit the boss 108 and/or sidewall 96 to compress inwardly allowing the washer 84 and the magnet 82 to be forced (e.g., pushed, pulled, pressed, etc.) onto the retainer 86. The boss 108 and/or the sidewall 96 then returned to their natural or uncompressed state, thereby mechanically retaining the washer 84 and the magnet 82 onto the retainer 86. The retainer 86 further includes one or more upwardly extending fins 110. The fins 110 include a top surface 112 that slopes downwardly an inwardly towards the bore 98 in order to guide the collar 78 into the bore 98 as the sprayhead 16 is returned to a docked position. The fins 110 may also help guide the hose end 38 through the retainer 86 during assembly.

According to one embodiment, the docking assembly 80 may be supported by coupling to the sidewall 60 of the spout 14. According to another embodiment, the docking assembly 80 may be interconnectedly supported by the base 12. According to the embodiment shown, the magnet 82 rests upon an annular support structure 114. The support structure 114 has an outwardly extending flange 116, which is supported by a column 118, which in turn may be supported by or may be part of the base 12. According to another embodiment, the docking assembly 80 may be supported by the base 12. According to the embodiment shown, the support structure 114 is part of a swivel assembly enabling the spout 14 to swivel (i.e., rotate relative to) relative to the base 12. Accordingly, the magnet 82 of the docking assembly 80 is proximate the swivel coupling between the base 12 and the spout 14. In other embodiments (see, e.g., the embodiment of FIGS. 14-15), the magnet 82 and the docking assembly 80 may be located proximate the top end 64 of the spout 14, between the top end 64 and the apex of the spout 14, at the apex of the spout 14, or between the apex of the spout 14 and the bottom end 62 of the spout 14. While the docking assembly 80 is shown to be located in the spout 14, is contemplated that the docking assembly 80 may be located elsewhere, for example, in the base 12 or a portion of the faucet beneath support surface.

Figure 13:
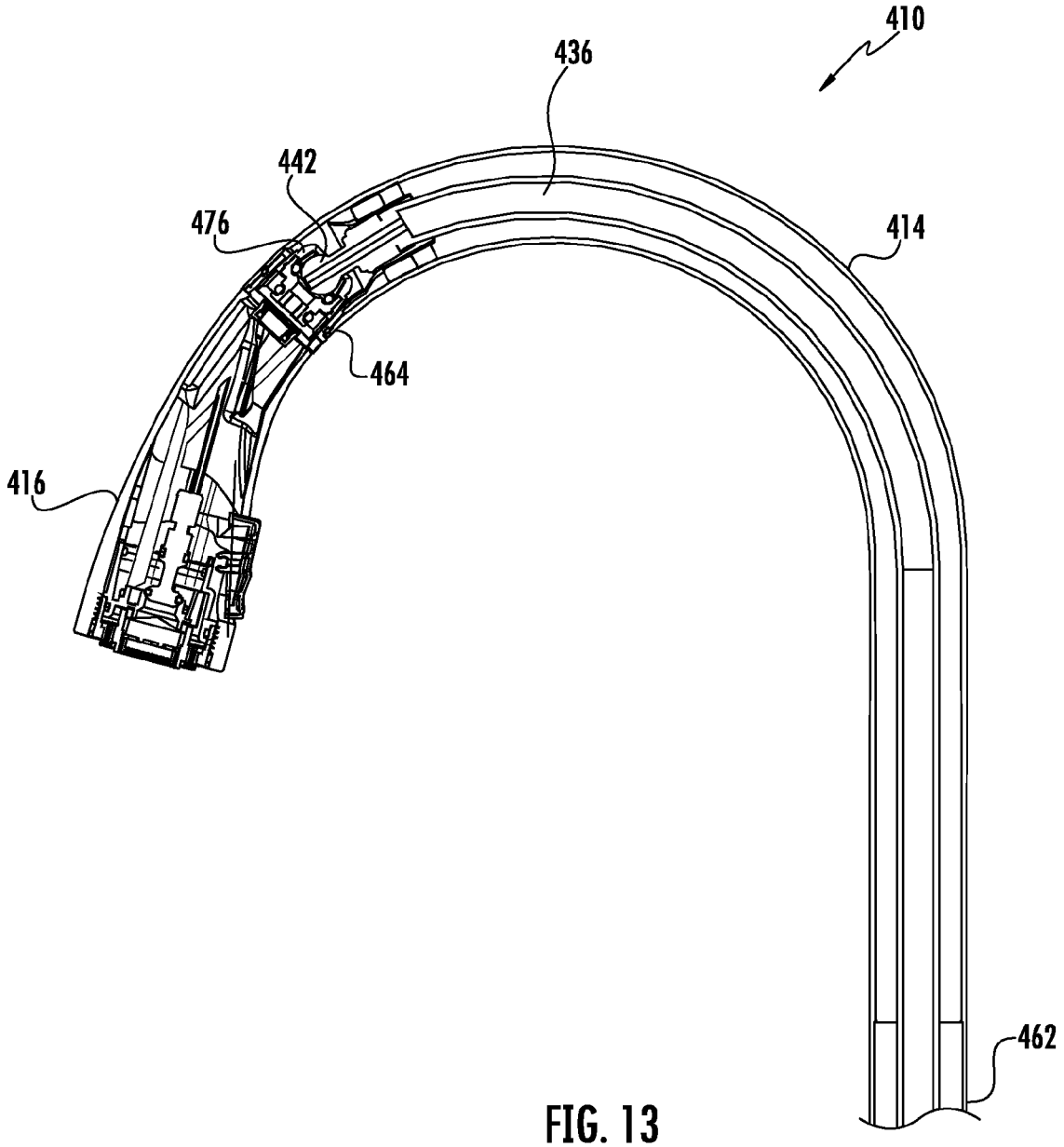
FIG. 13 is a right side elevational cross-section view of an enlarged portion of a faucet, shown according to another exemplary embodiment.

Referring generally to FIGS. 13-17, and more specifically to FIG. 13, portions of a faucet 410 and components thereof are shown, according to an exemplary embodiment. Components of faucet 410 that may be similar to components of faucet 10 are indicated with similar reference numerals. For example, the faucet 410 includes a spout 414 having a first or bottom end 462 and a second or top end 464. A sprayhead 416 is selectively held against the top end 464 of the spout 414.

Further referring to FIGS. 14-15, a portion of a hose assembly 435, including a hose 436, is shown, according to an exemplary embodiment. The hose 436 includes a first or inlet end 438 (not shown, but may be similar to inlet end 38 shown in FIG. 1) and a second or outlet end 440. The inlet end 438 may be coupled to a fluid source (e.g., an electronic valve, a mechanical valve, etc.), and the outlet end 440 may be coupled to the sprayhead 416. Accordingly, the hose 436 supplies fluid from the fluid source to the sprayhead 416.

The hose 436 may include a ball 442 to facilitate a moveable (e.g., rotatable, swivel, etc.) mechanical coupling to the sprayhead 416. The ball 442 is shown to include a member, shown as stem 443, which extends towards, and may extend into, the tubular portion 437 of the hose 436. The ball 442 may be secured to the tubular portion 437 of the hose 436 via a clamp, shown as ferrule 445, which may be crimped or swaged onto the hose 436 and stem. A magnetically responsive collar 478 may be coupled to the ferrule 445. According to the exemplary embodiment shown, the ball 442 and the stem 443 may be formed of as a single, unitary piece of any suitable material (e.g., brass, chrome-plated brass, stainless steel, etc.), and a collar/ferrule 445, 478 formed of a magnetically responsive material (e.g., iron, ferric alloy, magnet grade stainless steel, i.e., stainless steel having high iron content, etc.) may be pressed and/or crimped onto the outlet end 440 of the tubular portion 437 of the hose 436 to form an integral unit that includes the hose, ferrule/collar, and ball. In such an embodiment, the ball and stem may be formed of a substantially non-magnetically responsive material. According to another embodiment, the ball 442 and the stem 443 may be formed of as a single, unitary piece of any suitable material (e.g., brass, chrome-plated brass, stainless steel, etc.), and the ferrule 445 may be pressed and/or crimped onto the outlet end 440 of the tubular portion 437 of the hose 436 to form an integral unit that includes the hose, ferrule, collar, and ball. In such an embodiment, the ferrule 445 may provide burst strength and/or tensile strength, and a magnetically responsive collar 478 may be coupled to the ferrule 445. According to another embodiment, the ball 442, stem 443, ferrule 445, and the collar 478 are formed (e.g., cast, machined, etc.) as a single, unitary piece of magnet grade stainless steel. The unitary piece may be pressed and/or crimped onto the outlet end 440 of the tubular portion 437 of the hose 436 to form an integral unit that includes the hose, ferrule, collar, and ball.

Figure 16:
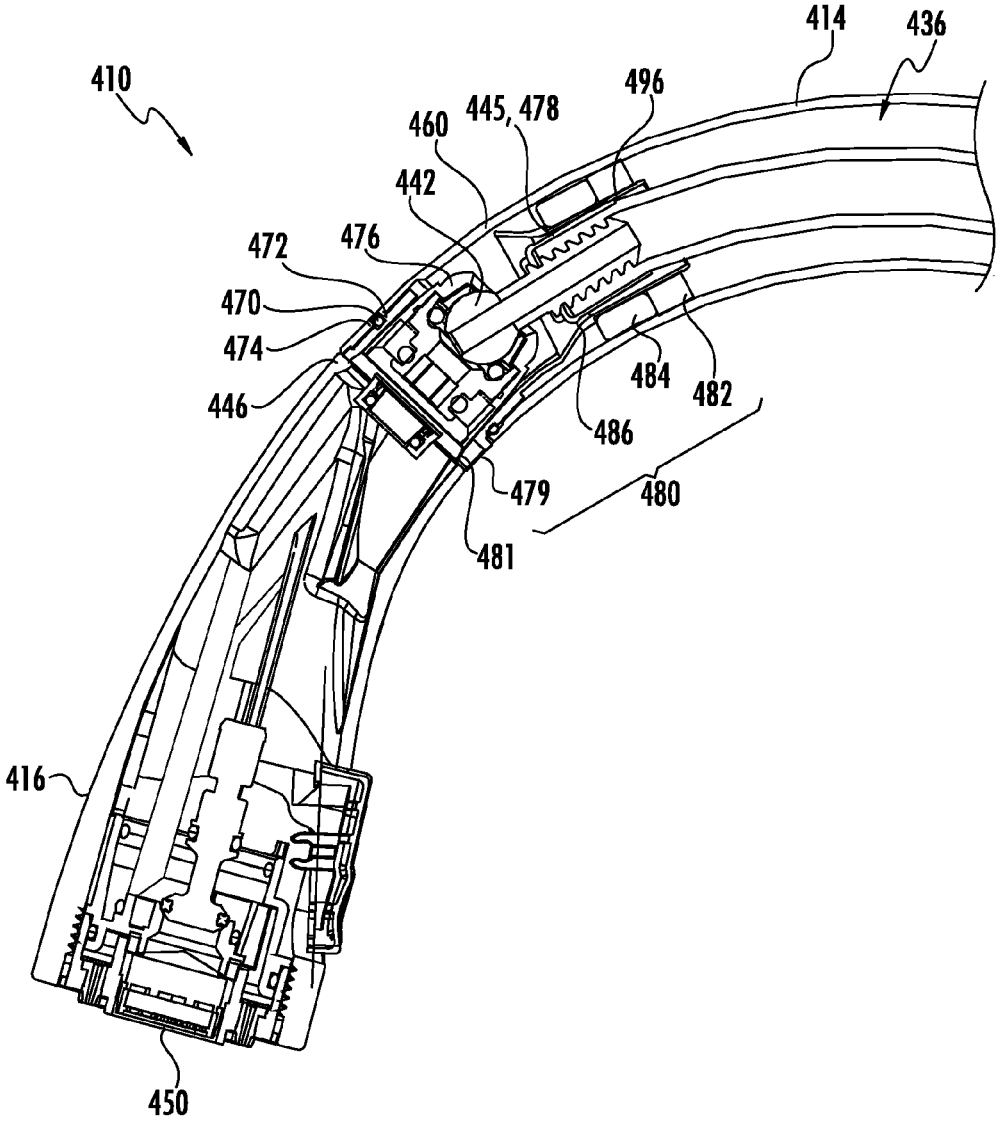
FIG. 16 is a right side elevational cross-section view of another enlarged portion of the faucet of FIG. 13, shown according to an exemplary embodiment.

Referring to FIG. 16, an enlarged view of a portion of faucet 410 is shown, with the sprayhead 416 in the docked position, according to an exemplary embodiment. According to the embodiment shown, the sprayhead 416 is generally similar to the sprayhead 16; however, the faucet 410 is not shown to include a sprayhead support 66, and the socket 476 of the sprayhead 416 is shown to extend beyond the inlet end 446 of the sprayhead 416 and into the spout 414 when the sprayhead 416 is in the docked position. According to the exemplary embodiment shown, the socket 476 is received in a portion of a docking assembly 480. The socket 476 of the sprayhead 416 at least partially defines a cup that is configured to receive and retain the ball 442 of the hose 436 while permitting the sprayhead 416 to freely rotate or swivel relative to the hose 436 and ball 442 thereof. According to the exemplary embodiment shown, the socket 476 is threadedly coupled to the body of the sprayhead 416 after the hose 436 is passed through the socket 476. According to other embodiments, the socket 476 may be coupled to the sprayhead 416, and the ball 442 of the hose 436 is then pressed or snapped into the socket 476. Accordingly, the ball 442 is coupled to and supported by the hose 436, and the sprayhead may be positioned onto the ball so as to freely rotate relative to the ball in a separable relationship therewith (i.e., the sprayhead and ball are not truly directly permanently coupled to or supported by each other, but rather the sprayhead rotates freely with respect to the ball as a ball-and-socket type joint arrangement).

The faucet 410 includes a docking assembly 480, which includes a magnet 482 and may include a field expander, shown as washer 484, and a retainer 486. As shown, the docking assembly 480 is located proximate the top end 464 of the spout 414, and the magnet 482 is located between the top end 464 and the apex of the spout 414. When the sprayhead 416 is in the docked position, the collar 478 (shown as unitarily formed as part of the ferrule 445 of the hose 436) is positioned proximate the docking assembly 480, and the magnet 482 magnetically couples to and attracts the collar 478 of the hose 436. When the sprayhead 416 is moved to the undocked position, the hose 436 is partially extracted from the spout 414, and the collar/ferrule 445, 478 is moved away from the magnet 482. During normal use, the collar 478 is moved sufficiently remote from the magnet 482 that the collar/ferrule 445, 478 and the magnet 482 magnetically decouple (i.e., magnetic field is sufficiently weak that the magnetic force applied to the collar/ferrule 445, 478 is negligible).

As the sprayhead 416 is returned to the docked position, the magnetic field from the magnet 482 couples to and attracts the collar/ferrule 445, 478 of the hose 436. According to the embodiment shown, the distance from the collar/ferrule 445, 478 to the sprayhead 416 is slightly less than the distance from the magnet 482 to the sprayhead 416. According to the embodiment shown, when the sprayhead 416 is in the docked position, the distance from the collar/ferrule 445, 478 to the end of the spout 414 is slightly less than the distance from the magnet 482 to the end of the spout 414. Accordingly, magnetic force of the docking assembly 480 acting on the hose 436 and components thereof (e.g., collar/ferrule 445, 478) holds the sprayhead 416 against the top end 464 of the spout 414, thereby preventing the sprayhead 416 from drooping, which may be aesthetically unappealing.

The sprayhead 416 includes predominantly non-magnetically responsive components such that no component of the sprayhead is significantly magnetically attracted to the magnet 482 in use. According to various embodiments, the sprayhead 416 may be formed or constructed of substantially or predominantly non-magnetically responsive components or materials. According to one embodiment, the sprayhead 416 may consist of substantially or predominantly non-magnetically responsive components or materials. For example, the components of the sprayhead 416 may be formed of plastic, brass, non-ferromagnetic stainless steels, aluminum, etc. While theoretically every material has magnetic properties, whether a material is magnetically responsive or not is based on its magnetic responsiveness under normal operating conditions in a magnetic field. According to one embodiment, the screen in the aerator 450 may be formed of a magnetically responsive steel. However, the screen does not magnetically couple to the magnet either because of the distance of the screen from the magnet 482 and washer 484 (i.e., a weak magnetic field), the small size of the screen (i.e., the weakness of the resulting force in response to the field relative to other forces acting on the screen), or both. That is, any theoretically measurable magnetic force that may exist between the screen of the aerator 450 and the magnet 482 is less than the force of gravity acting on the screen when in the docked position and is negligible in comparison to the force of gravity acting on the sprayhead 416. Similarly the sprayhead 416 may include springs or components having nickel coatings, which may have a theoretically measurable magnetic attraction to the magnet 482; however, these forces are negligible or insignificant in comparison to the force of gravity acting on the sprayhead 416.

Figure 17:
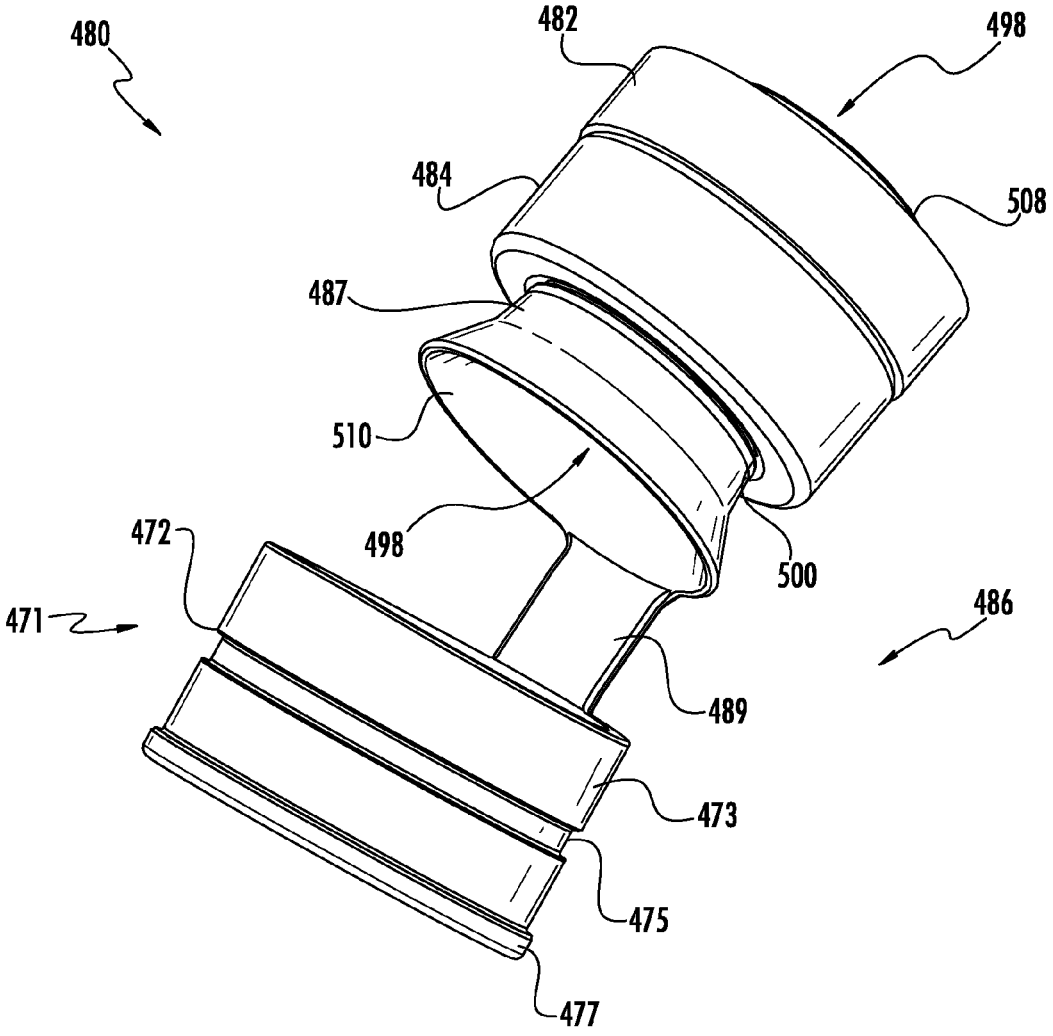
FIG. 17 is a perspective view of another component of the faucet of FIG. 13, shown according to an exemplary embodiment.

Further referring to FIG. 17, the docking assembly 480 is shown, according to an exemplary embodiment. The docking assembly 480 includes a magnet 482 and may include a field expander, shown as washer 484, and a retainer 486. The retainer 486 includes a first or inlet portion, shown as retaining portion 487, a second or outlet portion, shown as receiving portion 471, and third or connecting portion, shown as bridge 489. The bridge 489 is shown to flexibly interconnect the retaining portion 487 and the receiving portion 471.

The retaining portion 487 is shown to include an axially extending sidewall 496 (best seen in FIG. 16) defining a bore 498 and having a barb 508 at the inlet end and an outwardly extending ledge 500 (e.g., flange, etc.) spaced axially apart from the barb 508. During assembly, the magnet 482 and the washer 484 may be pressed or snapped over the barb 508 such that the magnet 482 and washer 484 become trapped between the barb 508 and the ledge 500, thereby retaining the magnet 482 and the washer 484 on the axially extending sidewall 496. The retaining portion 487 is further shown to include a funnel 510 (e.g., bell-shaped portion, conical portion, etc.) configured to guide the ferrule 445 into the bore 498 when the hose 436 is retracted (i.e., the sprayhead 416 is moved from the undocked position toward the docked position). According to the embodiment shown, the barb 508 and the funnel 510 are substantially annular; however according to other embodiments, one or both may be discrete barbs similar to bosses 108 and/or discrete fins 110, as shown in FIG. 5.

The receiving portion 471 is shown to include an axially extending sidewall 473. The sidewall 473 defines an annular groove 475, which at least partially defines an outwardly extending ledge 472. At the outlet end of the sidewall 473, the sidewall 473 defines an outwardly extending flange 477 and an inwardly angled surface 481 (shown in FIG. 16), which helps to guide the socket 476 of the sprayhead 416 into the receiving portion 471 when the sprayhead 416 is moved toward the docked position.

According to the embodiment shown in FIG. 16, the receiving portion 471 of the retainer 486 is retained in the spout 414 by a resilient member 470 (e.g., o-ring, snap ring, etc.) that is trapped between the outwardly extending ledge 472 on the receiving portion 471 and an inwardly extending ledge 474 on the sidewall 460 of the spout 414. As shown, the outwardly extending ledge 472 does not protrude from the sidewall 473 and is not received in the sidewall 460 of the spout 414. Instead, the resilient member 470 spans the gap between the retainer 486 and the spout 414. According to other embodiments, the retaining portion 471 may be threaded, press fit, or snapped into the spout 414. According to the exemplary embodiment shown, the outer diameter of the sidewall 473 of the retaining portion 471 is smaller than the inner diameter of the sidewall 460 of the spout 414 to facilitate insertion and compensate for the curvature of the spout 414, instead relying on the resilient member 470 to retain the retainer 486 in the spout 414. If the resilient member 470 were not present, the docking assembly 480 would fall out of the spout.

The retainer 486 may optionally include an alignment feature, shown as boss 479, shown to be located on the same side of the retainer 486 as the bridge 489. When the docking assembly 480 is inserted into the spout 414, the boss 479 is received in a slot in the inner side or underside of the top end of the sidewall 460 of the spout 414. Accordingly, when the boss 479 is received in the slot, the bridge 489 is oriented to the inner- or under-side of the spout 414, which allows the retainer to flex such that the retainer 486 follows the curvature of the spout 414. According to the exemplary embodiment shown, the retainer 486 flexes open such that the bridge 489 deflects away from the axis of the receiving portion 471 and the axis of the retaining portion 487 is not coaxial with the axis of the receiving portion 471. Such flexibility of the retainer 486 facilitates assembly of the retainer 486 into the spout 414. According to another embodiment, the boss 479 and respective slot in the spout 414 may be at any orientation relative to the bridge 489. According to another embodiment, the bridge 489 may be oriented to an outer- or upper-side of the spout 414 such that the retainer 486 flexes closed (i.e. to an acute angle); however, such an embodiment may constrict the ability of the ferrule 445 from easily passing into and/or through the retainer 486. According to other embodiments, the boss 479 may be a snap fit or press fit to help secure the retainer 486 to the spout 414; however, according to the embodiment shown, the boss 479 is a loose fit with the slot for alignment purposes because such a press or snap fit may interfere with proper seating of the resilient member 470.

Before discussing further details of the faucet 10 and components thereof, it should be understood that discussion and references to the docking assembly 80, 180, 280, 380 with respect to FIGS. 8A-12B are applicable to the docking assembly 480 and corresponding components thereof.

Figure 9A:
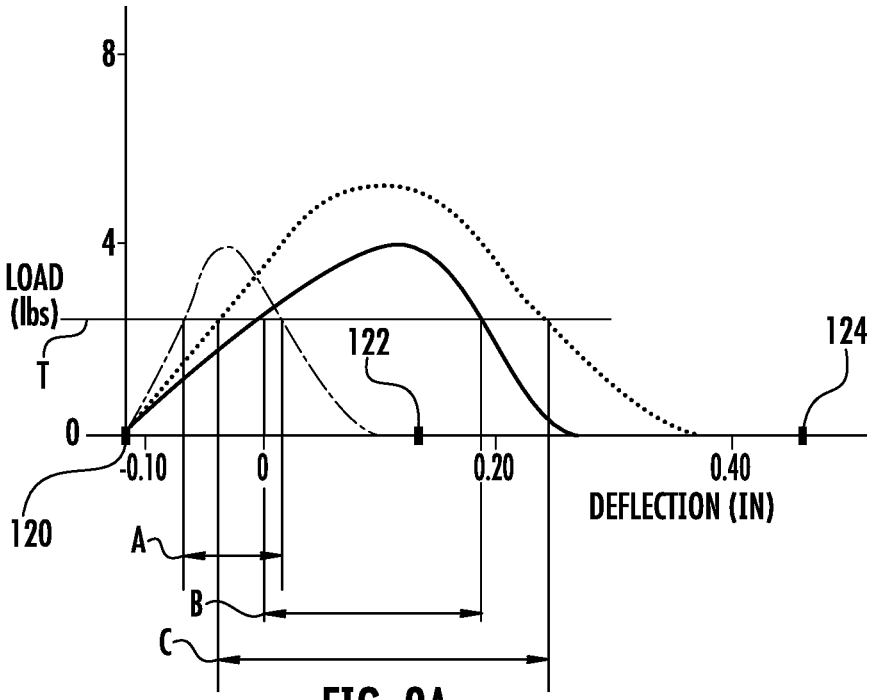
FIG. 9A is a graph of load versus deflection and corresponding schematic diagrams 9B-9D, shown according to an exemplary embodiment.
Figure 9B:
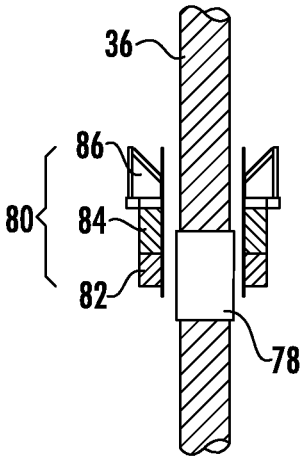
FIGS. 9B-9D are schematic diagrams of components of the faucet of FIG. 1 in various relation to one another, shown according to an exemplary embodiment.
Figure 9C:
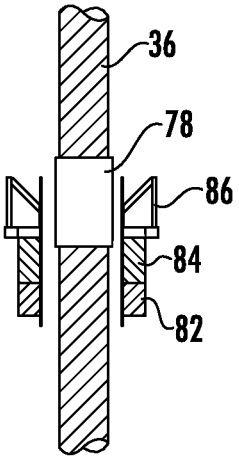
Figure 9D:
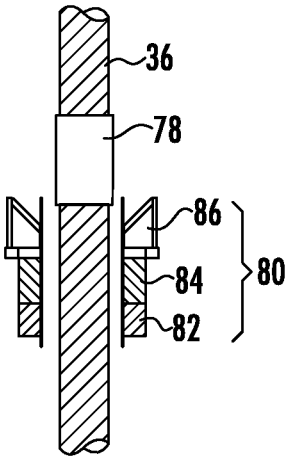

Referring to FIG. 9A, a graph of load versus deflection and corresponding schematic diagrams 9B-9D of the collar 78 relative to the docking assembly 80 are shown, according to exemplary embodiments. FIGS. 9B, 9C, and 9D generally correspond to abscissa 120, abscissa 122, and abscissa 124 in FIG. 9A, respectively. Specifically referring to FIG. 9B, the collar 78 is attracted to the center of the magnet 82 (e.g., the center of the magnetic field, the center of the magnetic flux, etc.). At this location, the magnetic forces attracting the collar 78 in both axial directions are balanced, and no resultant magnetic load is applied to the collar 78. Referring to FIG. 9D, the collar 78 is sufficiently far away from the magnet 82 that the magnetic load on the collar 78 is negligible. Referring to FIG. 9C, the collar 78 is shown in a position at which the magnetic load on the collar 78 is at a maximum. This location is between the positions of FIGS. 9B and 9D.

Referring to FIG. 9A, when the magnetic load exceeds a threshold value T, the magnetic forces on the collar 78 exceed the weight of the sprayhead 16 and an unsupported portion of the hose 36. Thus, when the magnetic forces exceed the threshold value, the sprayhead 16 is retracted and/or retained to the spout 14. This region in which the magnetic forces exceed the threshold value T may be referred to as the "sweet spot". According to an exemplary embodiment, the collar 78 is located on the hose 36 such that when the sprayhead 16 is in the docked position, the collar 78 is in the sweet spot. Thus, a predictable minimum load is provided at all tolerance extremes, and the sprayhead 16 is retained in the docked position.

Further referring to FIG. 8A, the dashed line in FIG. 9A corresponds to a docking assembly having a magnet 82 only. In such case the sweet spot A is relatively narrow, that is, the sweet spot has a relatively short axial length. Further referring to FIG. 8B, the solid line in FIG. 9A corresponds to a docking assembly having a magnet 82 and a washer 84. In such case, the magnitude of the magnetic forces remains substantially the same; however, the forces occur over a greater axial distance. Thus, the sweet spot B is expanded, thereby allowing greater tolerances and providing a more robust magnetic docking system. The dotted line in FIG. 9A corresponds to a docking assembly having a field expander (e.g., a washer) and a larger magnet. In such case, the magnitude of the force increases and the forces occur over an even greater distance, thus creating an even larger sweet spot C. The long smooth curve of the larger magnet and field expander provides the user docking and undocking the sprayhead 16 a more gentle retraction and a more gentle extension. Accordingly, the size, shape, number, and composition (e.g., materials, magnetic density, etc.) of the magnets and field expanders may be selected to provide a desired force magnitude and sweet spot size for the space available in the faucet in view of cost constraints. Thus, while exemplary values and curves are shown and described in FIG. 9A, other curves may result for other configurations of magnets and field expanders.

Figure 11:
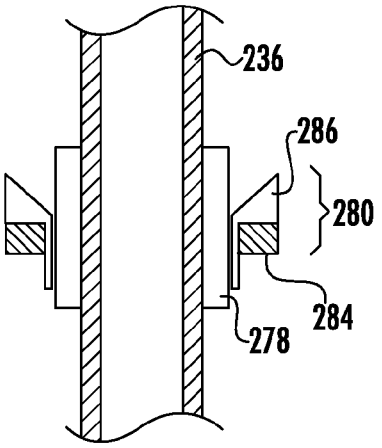
FIG. 11 is a schematic cross-section view of components of a docking system, shown according to another exemplary embodiment.
Figure 12A:
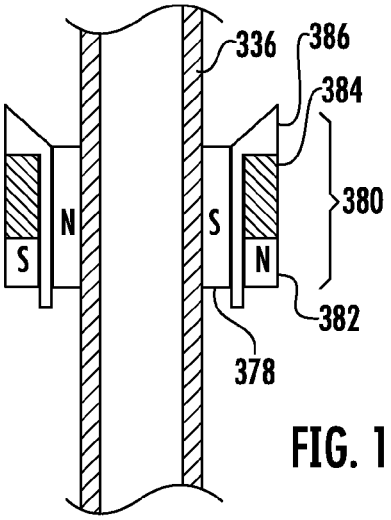
FIGS. 12A and 12B are schematic cross-section views of components of a docking system, shown according to another exemplary embodiment.
Figure 12B:
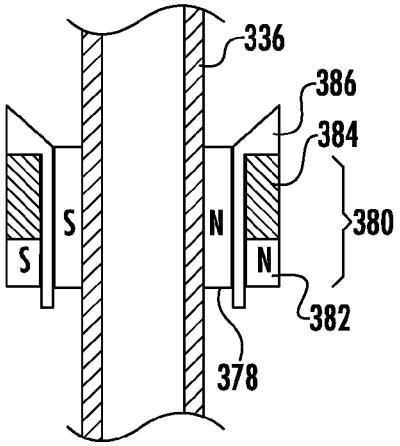

Referring generally to FIGS. 11-12B, it is contemplated that the collar coupled to the hose may be magnetized (e.g., be a permanent magnet or an electromagnet). Referring specifically to the exemplary embodiment of FIG. 11, a docking assembly 280 includes a retainer 286 supporting a magnetically responsive ring 284. A magnetized collar 278 is coupled to the hose 236. In operation, the magnetic interaction between the collar 278 and the ring 284 draw the collar 278 towards a position in which the ring 284 circumscribes a midpoint (e.g., midsection, equator, magnetic equator, etc.) of the collar 278.

Referring to the exemplary embodiment of FIGS. 12A and 12B, a docking assembly 380 includes a magnet 382, a field expander 384, and a retainer 386. A hose 336 and a magnetized collar 378 pass through the docking assembly 380. FIG. 12A shows a first position in which the magnetic poles of the collar 378 are opposite the poles of the magnet 382 (e.g., N-S or S-N). Accordingly, the collar 378 is attracted to the magnet 382, and a sprayhead coupled to the hose 336 is retained in a docked position. FIG. 12B shows a second position in which the magnetic poles of the collar 378 are similarly aligned with the poles of the magnet 382 (e.g., N-N or S-S). Accordingly, the collar 378 is repelled by the magnet 382, and the sprayhead coupled to the hose 336 is pushed out of the docked position. According to one embodiment, the hose 336 may be sufficiently rigid such that when the sprayhead is rotated (e.g., by a user desiring to undock the sprayhead), the collar 378 rotates relative to the docking assembly 380 from the first position to the second position, thereby easing removal of the sprayhead from the docked position. When the sprayhead is returned to the docked position, the magnetic fields of the collar 378 and the magnet 382 oppositely align the poles of the collar and the magnet into the first position. According to another embodiment, the magnet 382 is an electromagnet. A controller may be configured to reverse the polarity of the magnet 382 in response to a signal. For example, the signal may be from a touch sensor indicating that a user has touched the sprayhead 16.

The construction and arrangement of the elements of the faucet as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet comprising:
- a sprayhead;
- a spout;
- a hose assembly comprising:
  - a hose passing through the spout, the hose having a first end for receiving fluid from a fluid source and a second end for providing the fluid to the sprayhead;
  - a ball rotatably coupled to the sprayhead; and
  - a magnetically responsive ferrule securing the ball to the second end of the hose;
- a magnet located in the spout and configured such that when the sprayhead is brought toward the spout, the ferrule magnetically couples to the magnet, thereby generating sufficient magnetic force upon the ferrule to retain the sprayhead against the spout; and
- a docking assembly supported in the spout, the docking assembly comprising:
  - a retaining portion configured to support the magnet; and
  - a receiving portion configured to receive a socket of the sprayhead when the sprayhead is coupled to the spout and comprises an annular groove configured to receive an o-ring, the o-ring also received in a corresponding annular groove in the spout, thereby securing the docking assembly to the spout.

2. The faucet of claim 1, wherein the sprayhead is formed of non-magnetically responsive materials.

3. The faucet of claim 1, wherein the ball is configured to be removably received within a portion of the sprayhead.

4. The faucet of claim 3, wherein the sprayhead comprises a socket configured to receive the ball, thereby permitting the sprayhead to rotate relative to the magnetically responsive ferrule.

5. The faucet of claim 3, wherein the magnetically responsive ferrule is clamped to the second end of the hose.

6. The faucet of claim 1, wherein the ferrule is crimped to the hose.

7. The faucet of claim 6, wherein the hose assembly comprises a member extending into the second end of the hose, and wherein the ferrule is crimped onto the hose about the member such that the ball is secured to the hose.

8. The faucet of claim 1, wherein the sprayhead comprises a socket defining a cup configured to rotatably receive the ball of the hose assembly.

9. The faucet of claim 1, wherein the sprayhead is substantially constructed of non-magnetically responsive materials.

10. The faucet of claim 1, further comprising a field expander located adjacent the magnet and configured to expand a magnetic field created by the magnet;

wherein the retaining portion includes a first sidewall, a barb formed at a first end of the first sidewall, and a ledge spaced axially apart from the barb such that the magnet and the field expander are trapped between the ledge and the barb, thereby retaining the magnet and the field expander on the retaining portion.

11. A faucet comprising:

a spout extending from a first end to a second end;

a sprayhead consisting of predominantly non-magnetically responsive components, comprising a socket, and movable between a docked position, in which the sprayhead is in contact with the second end of the spout, and an undocked position, in which the sprayhead is spaced apart from the spout;

a hose assembly comprising:

a hose passing through the spout, the hose having an inlet end for receiving fluid from a fluid source and an outlet end for providing the fluid to the sprayhead; and an end portion fixed to the outlet end of the hose, the end portion comprising a ball rotatably received in the socket of the sprayhead and a magnetically responsive collar that fixes the ball to the hose;

a docking assembly located in the spout proximate the second end, the docking assembly comprising:

a retainer having an axially-extending, first sidewall defining a bore allowing the hose assembly to pass therethrough; and a magnet defining an aperture allowing the first sidewall of the retainer to pass therethrough, wherein when the sprayhead is in the docked position, the magnet magnetically couples to the end portion of the hose, thereby applying sufficient magnetic force to the hose to retain the sprayhead against the spout; and a field expander located adjacent the magnet and configured to expand a magnetic field created by the magnet;

wherein the retainer comprises a retaining portion, the retaining portion including the first sidewall, a barb formed at a first end of the first sidewall, and a ledge spaced axially apart from the barb such that the magnet and the field expander are trapped between the ledge and the barb, thereby retaining the magnet and the field expander on the retaining portion.

12. The faucet of claim 11, wherein the retainer is located in the spout of the faucet and the retainer supports the magnet.

13. The faucet of claim 12, wherein the spout is rotatably coupled to a base of the faucet, and the retainer is supported by the faucet inside the spout.

14. The faucet of claim 13, wherein the spout comprises a top end and a bottom end, and wherein the retainer is located proximate the top end of the spout.

15. The faucet of claim 11, wherein the retainer of the docking assembly is coupled to the spout and configured to support the magnet.

16. The faucet of claim 15, wherein the docking assembly comprises a receiving portion configured to receive the socket of the sprayhead when the sprayhead is coupled to the spout and comprises an annular groove configured to receive an o-ring, the o-ring also received in a corresponding annular groove in the spout, thereby securing the docking assembly to the spout.

17. The faucet of claim 16, wherein the retaining portion and the receiving portion are flexibly coupled by a bridge portion.

18. The faucet of claim 11, wherein the retaining portion comprises a funnel located opposite the first end of the first sidewall, the funnel configured to guide the collar into the bore of the retainer when the sprayhead moves from the undocked position to the docked position.

19. The faucet of claim 11, wherein:

a sidewall of the spout defines an inwardly extending ledge;

the ledge of the retainer is an outwardly extending ledge; and the docking assembly comprises a resilient member spanning a gap between the inwardly extending ledge and the outwardly extending ledge, thereby securing the docking assembly in the spout.

* * * * *